US008613548B2

(12) United States Patent
Murray

(10) Patent No.: US 8,613,548 B2
(45) Date of Patent: Dec. 24, 2013

(54) FLEXIBLE POUCH WITH CURVILINEAR SHAPE AND METHOD OF FORMING

(75) Inventor: R. Charles Murray, Lakewood Ranch, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 984 days.

(21) Appl. No.: 12/233,631

(22) Filed: Sep. 19, 2008

(65) Prior Publication Data

US 2009/0028470 A1 Jan. 29, 2009

Related U.S. Application Data

(63) Continuation-in-part of application No. 11/551,071, filed on Oct. 19, 2006, now abandoned, which is a continuation-in-part of application No. 11/195,906, filed on Aug. 3, 2005, now abandoned.

(60) Provisional application No. 60/598,394, filed on Aug. 3, 2004.

(51) Int. Cl.
*B65D 30/10* (2006.01)

(52) U.S. Cl.
USPC ..... 383/121; 383/107

(58) Field of Classification Search
USPC ..... 383/80, 127, 121, 119; 53/456
See application file for complete search history.

(56) References Cited

U.S. PATENT DOCUMENTS 51,722 A * 12/1865 Hurd ..... 383/121
2,800,163 A * 7/1957 Rusch ..... 156/253
3,355,080 A * 11/1967 Anders et al. ..... 229/123.1
3,478,952 A * 11/1969 Perlman ..... 206/521
3,483,061 A * 12/1969 Mitsuo et al. ..... 156/380.6
3,516,537 A * 6/1970 Griffiths et al. ..... 206/497
3,558,406 A * 1/1971 Kugler ..... 56/515
3,737,329 A * 6/1973 Strelchuk ..... 383/24
3,810,503 A * 5/1974 Lewis et al. ..... 383/96
3,830,270 A * 8/1974 Hagert et al. ..... 224/148.5
3,982,029 A * 9/1976 Rausing ..... 426/106
4,232,048 A * 11/1980 Palm et al. ..... 426/115
4,415,085 A * 11/1983 Clarke et al. ..... 206/526
4,418,733 A * 12/1983 Kallman ..... 383/11
4,742,908 A * 5/1988 Thomas et al. ..... 206/204
4,759,472 A * 7/1988 Strenger ..... 222/92
5,210,993 A * 5/1993 van Boxtel ..... 53/455
5,971,613 A * 10/1999 Bell ..... 383/107
6,270,819 B1 * 8/2001 Wiese ..... 426/129
6,641,307 B2 * 11/2003 Matsuda et al. ..... 383/38
6,655,837 B2 * 12/2003 Matsuda et al. ..... 383/38

(Continued)

*Primary Examiner* — Jes F Pascua
*Assistant Examiner* — Peter Helvey
(74) *Attorney, Agent, or Firm* — Gifford, Krass, Sprinkle, Anderson & Citkowski, P.C.

(57) ABSTRACT

A flexible pouch for containing a carbonated product, and having a curvilinear shaped lower edge and method of producing the same is provided. The pouch includes a pouch body having an upper edge, a curvilinear bottom edge, and a side edge extending between the upper edge and bottom edge. The curvilinear bottom edge includes a curvilinear bottom seal corresponding to the curvilinear bottom edge, to distribute a force from the product evenly across the curvilinear bottom seal. The method forming a pouch body from a panel of laminate material, and aligning the first side edge with the second side edge to form the front wall and back wall of the pouch body. The method includes forming a side seal and forming a curvilinear bottom seal corresponding to the curvilinear bottom edge of the pouch body.

9 Claims, 18 Drawing Sheets

(56) References Cited

U.S. PATENT DOCUMENTS

| | | | | |
|---|---|---|---|---|
| 6,790,468 | B1 * | 9/2004 | Mize et al. | 426/129 |
| 2002/0079238 | A1 * | 6/2002 | Wilson et al. | 206/204 |
| 2002/0147091 | A1 * | 10/2002 | Healy et al. | 493/213 |
| 2005/0117818 | A1 * | 6/2005 | Brans et al. | 383/120 |
| 2005/0265636 | A1 * | 12/2005 | Michalsky | 383/104 |
| 2006/0126970 | A1 * | 6/2006 | Perell | 383/61.1 |
| 2006/0196784 | A1 * | 9/2006 | Murray | 206/219 |
| 2006/0233467 | A1 * | 10/2006 | Mize | 383/37 |
| 2007/0047851 | A1 * | 3/2007 | Sato et al. | 383/104 |
| 2007/0211967 | A1 * | 9/2007 | Murray | 383/38 |
| 2007/0217717 | A1 * | 9/2007 | Murray | 383/38 |
| 2008/0247684 | A1 * | 10/2008 | Binks et al. | 383/113 |
| 2008/0292225 | A1 * | 11/2008 | Dayrit et al. | 383/207 |
| 2009/0028470 | A1 * | 1/2009 | Murray | 383/80 |
| 2009/0056281 | A1 * | 3/2009 | Murray | 53/455 |
| 2009/0116768 | A1 * | 5/2009 | Huerta et al. | 383/207 |
| 2010/0155396 | A1 * | 6/2010 | Warner | 220/4.24 |

* cited by examiner

FLEXIBLE POUCH WITH CURVILINEAR SHAPE AND METHOD OF FORMING

RELATED APPLICATION

This application is a continuation-in-part of U.S. patent application Ser. No. 11/195,906 filed Aug. 3, 2005, which claims priority of U.S. Provisional Patent Application Ser. No. 60/598,394 filed Aug. 3, 2004, which is incorporated herein by reference.

BACKGROUND OF THE INVENTION

1. Field of the Invention

The present invention relates generally to a flexible pouch for packaging a product and, more specifically, to a flexible pouch with a curvilinear bottom shape for packaging a product and a method of manufacturing the same.

2. Description of the Related Art

Various types of disposable, portable containers are known in the art for storing a fluid or dry product, such as a liquid, granular material, powder or the like. Examples of containers include a cup, a metal can, a plastic bottle, a glass bottle or a flexible pouch. Consumers prefer the convenience of flexible pouches over other types of containers due to their shape, size, shelf life and storage adaptability. Manufacturers recognize the packaging benefits of a flexible pouch, since the pouch can be formed and filled on the same manufacturing line.

Flexible pouches have been used for some time to distribute noncarbonated beverages, such as fruit juice and the like. However, their use with other types of beverages, including carbonated beverages, has been limited. With respect to carbonated beverages, the presently available materials are somewhat permeable, thereby allowing loss of the internal carbon dioxide gas from the pouch and its replacement with oxygen. The presence of oxygen in the filled pouch increases the chance of bacteria forming, or may affect the taste. The flexible pouch is made from a flexible material, preferably a laminate composed of sheets of plastic or aluminum or the like. An outer layer of the material may include preprinted information, such as a logo or the like, to provide the consumer with information regarding the contents of the pouch. The pouch may be formed and/or filled using a machine, such as a horizontal form-fill-seal machine with a single or multiple lanes, a flat bed pouch machine, a vertical form-fill machine, or the like.

While the above described pouch functions well, the seam may be susceptible to leakage, depending on the product contained therein and the manufacturing technique used to form the pouch. Thus, there is a need in the art for a flexible pouch with an improved bottom seal, and an improved method of making such a flexible pouch, that can be used to hold various types of products.

SUMMARY OF THE INVENTION

Accordingly, the present invention is an improved flexible pouch for containing a carbonated product, and having a curvilinear shaped lower edge and method of producing the same is provided. The pouch includes a pouch body having an upper edge, a curvilinear bottom edge, and a side edge extending between the upper edge and bottom edge. The curvilinear bottom edge includes a curvilinear bottom seal corresponding to the curvilinear bottom edge, to distribute a force from the product evenly across the curvilinear bottom seal. An opening device is integrally formed in the pouch body for accessing the carbonated product contained within the pouch.

A method of forming a flexible pouch having a curvilinear bottom edge with a carbonated product includes the steps of forming a body of the pouch from a panel of laminate material, and aligning the first side edge with the second side edge to form the front wall and back wall of the pouch body. The method also includes the steps of forming a side seal in the aligned first side edge and the second side edge and forming a curvilinear bottom seal corresponding to the curvilinear bottom edge of the pouch body, to distribute a force from the product evenly across the curvilinear bottom seal.

One advantage of the present invention is that a flexible pouch with a curvilinear bottom shape and an improved method of making the flexible pouch is provided. Another advantage of the present invention is that a flexible pouch and method of making a flexible pouch is provided that utilizes a laminate material that includes PET, foil, nylon and cast polypropylene. Still another advantage of the present invention is that a flexible pouch and the method of making a flexible pouch is provided that includes an improved curvilinear bottom seal. A further advantage of the present invention is that a flexible pouch and method of making a flexible pouch is provided that includes a first curvilinear bottom seal and second curvilinear bottom seal, and an air pocket formed therebetween. Still a further advantage of the present invention is a flexible pouch and a method of making a flexible pouch filled with a product is provided that is cost effective to manufacture. Yet a further advantage of the present invention is that the flexible pouch retains its shape as the product is removed. Another advantage of the present invention is that the pouch stands up and is made of a laminate material with an opening means. Still another advantage of the present invention is that the flexible pouch is filled with a carbonated product, has an ergonomic shape and is comfortable for a user to hold. A further advantage of the present invention is that the flexible pouch is filled with a carbonated product and has a spout fitment and cap.

Other features and advantages of the present invention will be readily appreciated, as the same becomes better understood after reading the subsequent description taken in conjunction with the accompanying drawings.

BRIEF DESCRIPTION OF THE DRAWINGS

FIGS. 9*a*-9*c* are elevational views of a stand-up flexible pouch with a flat seam, fitment and insert, according to the present inventions.

DESCRIPTION OF THE PREFERRED EMBODIMENT(S)

Referring to FIGS. 1-11, 11*a*-23, and 25-26, a flexible pouch 10 is illustrated. The pouch 10 may be filled with a product (not shown) and sealed. Various types of products are contemplated, such as a dry product or a fluid product. In addition, the product may be a food item, or a non-food item. It is contemplated that the pouch may contain a single portion or multiple portions of the product. In this example, the product is a carbonated product.

Figure 6A:
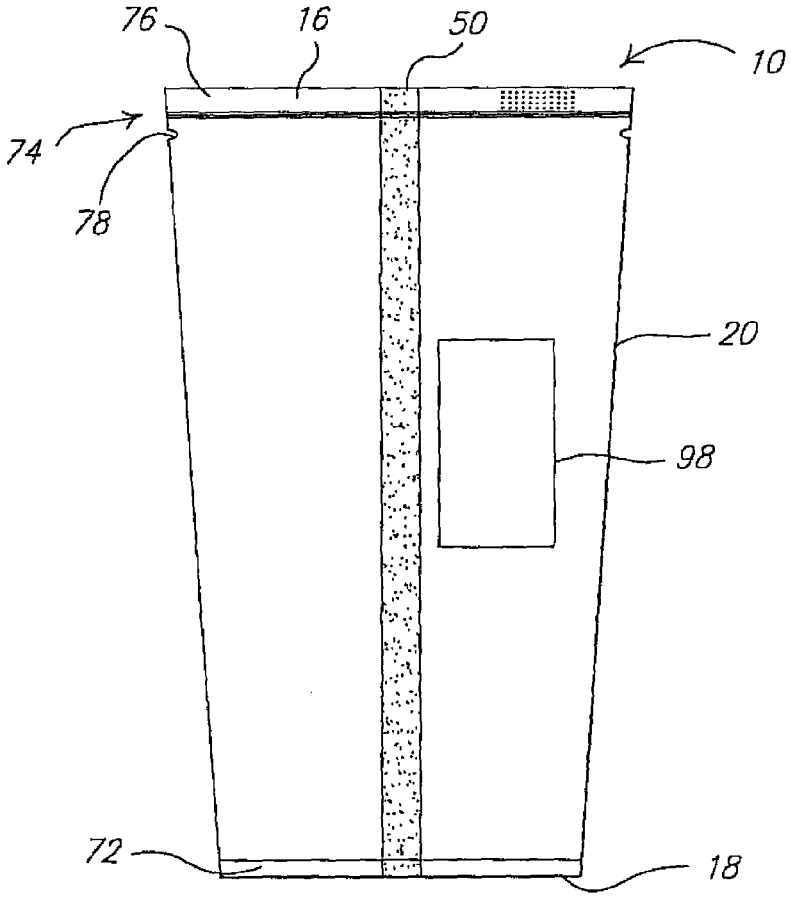
FIG. 6*a* is an elevational view of a stand-up flexible pouch with a flat seam, tear notch and insert, according to the present inventions.
Figure 7A:
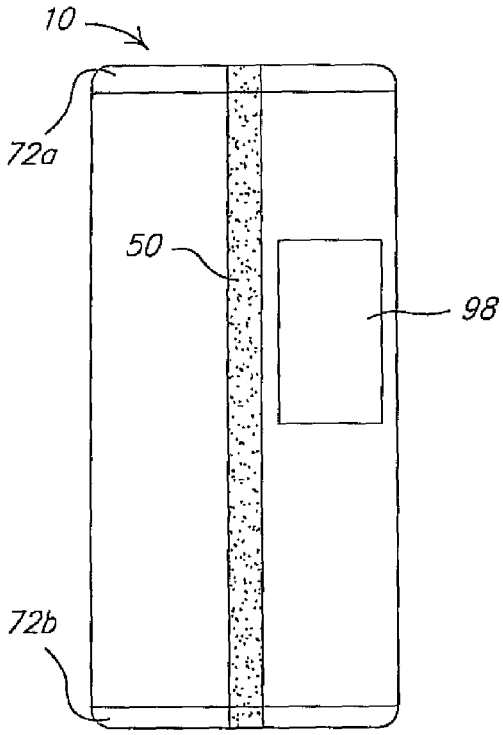
FIG. 7*a* is an elevational view of a stand-up flexible pouch with a flat seam, straw hole, pull tab opening means and insert, according to the present inventions.
Figure 7B:
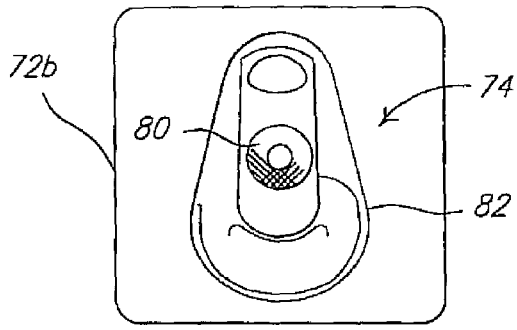
FIG. 7*b* is a top view of an insert with a pull tab and straw hole, according to the present inventions.
Figure 7C:
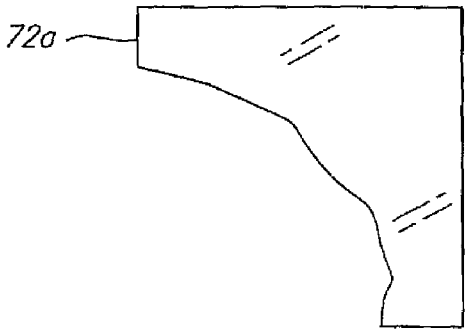
FIG. 7*c* is a cutaway view of an insert, according to the present inventions.
Figure 8A:
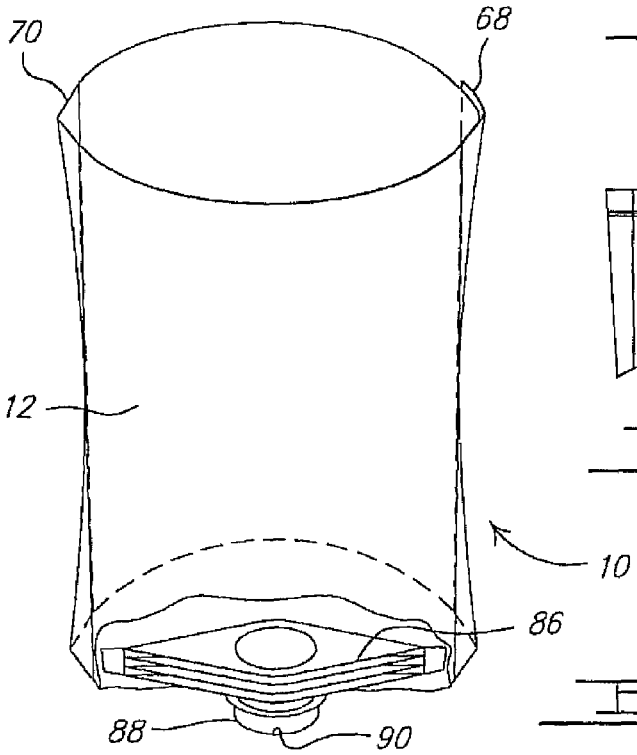
FIGS. 8*a* and 8*b* are partial views of a stand-up flexible pouch with a flat seam, fitment and side gussets, according to the present inventions.
Figure 8B:
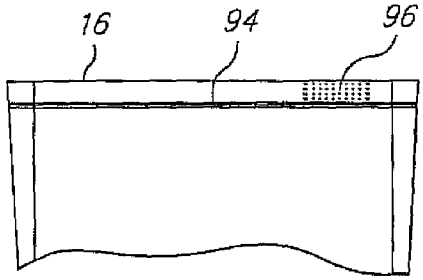
Figure 8A:
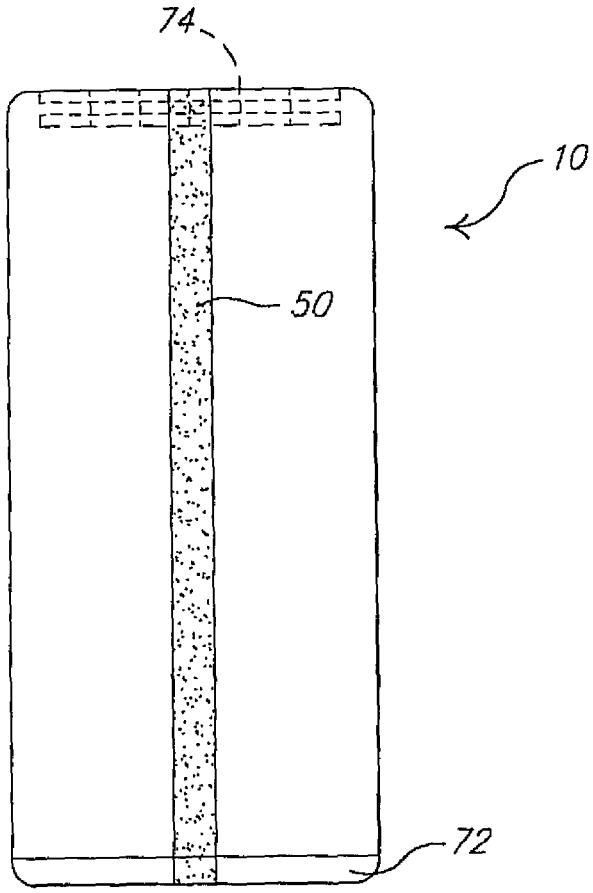
Figure 8B:
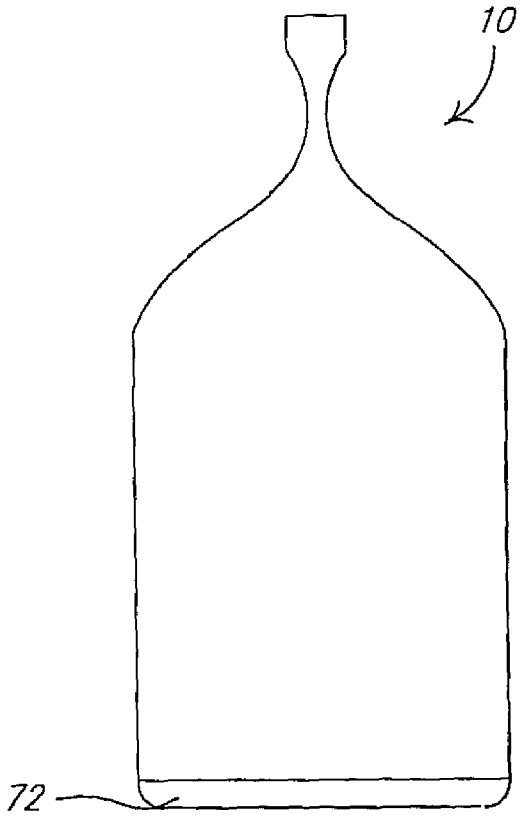
Figure 8C:
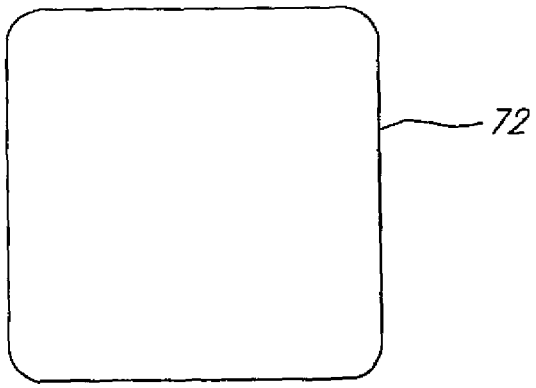
Figure 10:
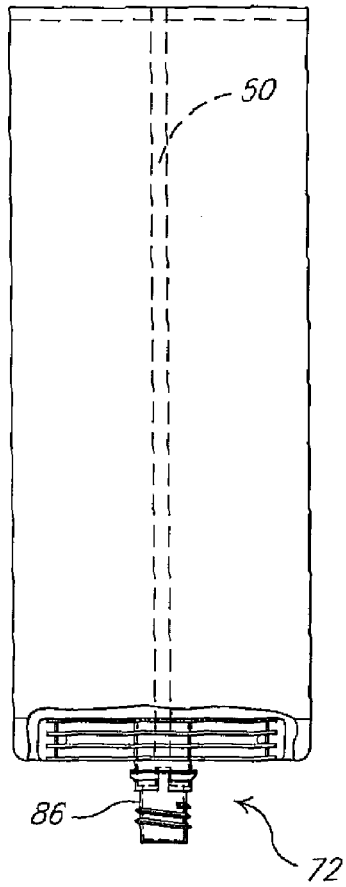
FIG. 10 is another elevational view of a stand-up flexible pouch with a flat seam and fitment, according to the present inventions.
Figure 11A:
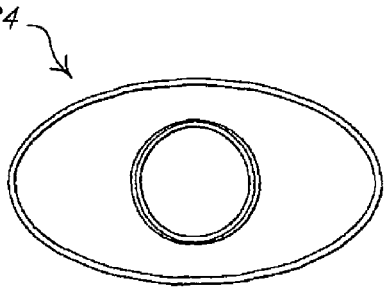
FIGS. 11*a*-11*d* are elevational views of stand-up caps for the flexible pouch with fitment, according to the present inventions.
Figure 11B:
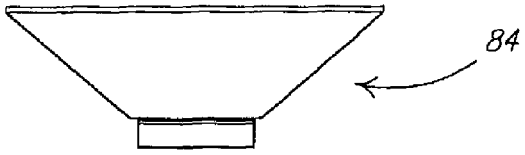
Figure 11C:
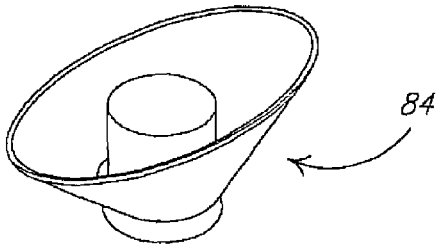
Figure 11D:
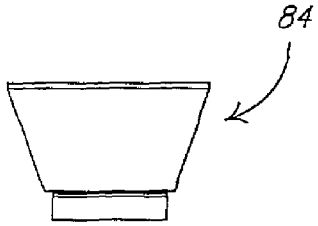

The flexible pouch 10 is preferably formed from a roll of preprinted material of laminate layers. The laminate material is typically a three, four, five or more gauge material. The outer layer is usually preprinted. Alternatively, at least a portion of the material may be not printed, i.e. translucent, in order to view the contents contained therein, as shown in FIGS. 6*a* and 7 at 98 as a window. The clear portion could be in a gusset or insert. An outer layer of material may include preprinted information. Similarly, a sleeve, to be described, may also include preprinted information.

The choice of sheet layer material is non-limiting, and is influenced by factors such as the product contained in the pouch, the shape of the pouch, or the anticipated use of the pouch. One example of a laminate material structure includes at least one layer of virgin polyethylene terephthalate (PET), at least one layer of aluminum foil and another layer such as EVOH, PET, polyethylene or nylon or the like. Another type of laminate material structure may also include a metalized foil paper layer laminated to a cast polypropylene layer and another layer of PET, polyethylene or EVOH. There may be a fourth layer of nylon. Similarly, the laminate structure may include a cast polypropylene (CPP) layer, a polyethylene (PET) layer, a foil (AL) layer, a nylon (ONO) layer and another CPP layer. Another structure is the use of nylon, foil, nylon and cast polypropylene (ONO/AL/ONO/CPP) or CPP/NY/AL/CPP. Another example of a material structure is ONO/AL/COEX-ONO-LDPE, Material structures that include CPP are well suited for packaging a beverage, such as beer, wine or other carbonated fluids, to add strength to the walls of the pouch, preserve the carbonation, and protect the AL layer from cracking. Carbonation is beneficial since it acts as a microbiocide and preserves the flavor and aroma of the products. The use of cast polypropylene laminate material also assists in retaining the filled shape of the container, even as the product is removed from the pouch 10. A further example of a laminate material structure is CPP/AL/ONO/PE. This structure works well when the product has a short shelf life, and the nylon eliminates stretching or cracking of the AL layer.

It should be appreciated that if the filled carbonated pouch is stored at ambient temperature, the laminate will start to creep after a period of time, such as ten days. The laminate material may include an extrusion layer to contain "creepage" or "stretch" of the film after filling due to carbonation expansion, if the product is carbonated. In addition, the selected material may be organoleptic compliant in order to avoid the transfer of odor contaminates to the product, or product contamination during the shelf life period of the product.

The body of the pouch is formed from a panel of the laminate material. The panel 48 has an inner surface 24 that is adjacent the product, and an outer surface 22. The pouch body includes a front wall 12 and a back wall 14, an upper edge 16, a side edge 20 and a bottom edge 18. The edges of the panel are sealed together to form a seam. The pouch may include two side seams, or one single seam. In an example of a pouch formed using a single panel 48 of material, the side edges 20, or joined along a center seam. In another example of a pouch formed from a single panel, the side edges are formed along one side seam. In an example of a pouch formed using two sheets of material, the edges are joined along two side seams.

Figure 1:
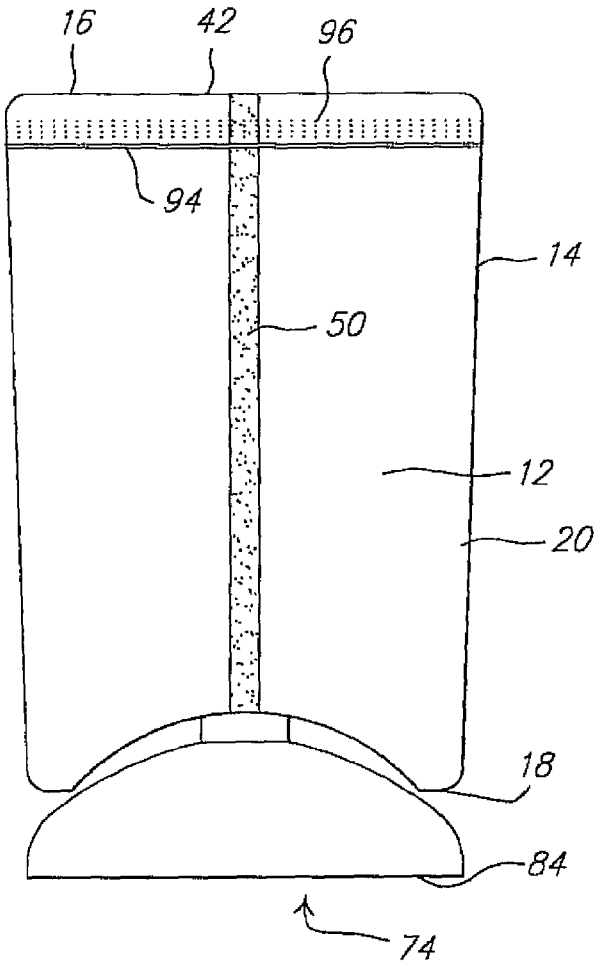
FIG. 1 is an elevational view of a flexible pouch with a flat seam, according to the present inventions.
Figure 2A:
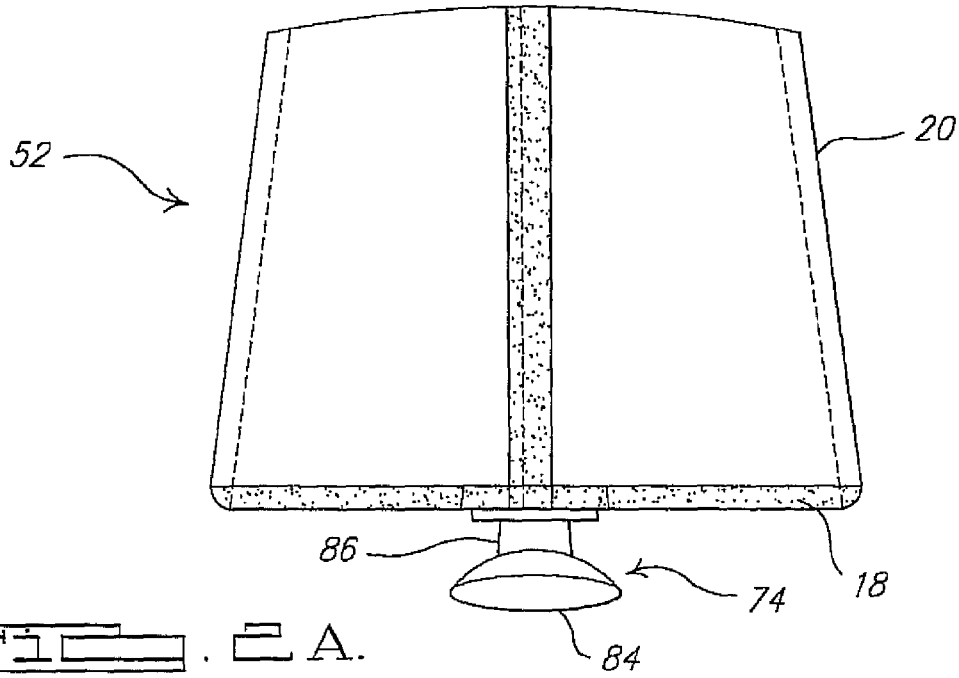
FIG. 2*a* is an elevational view of a flexible pouch with a folded flat seam according to the present inventions.
Figure 2B:
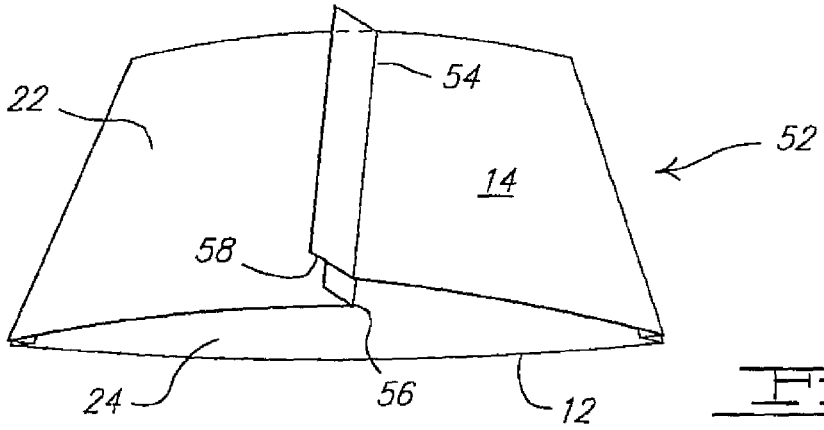
FIG. 2*b* is a perspective side view illustrating a folded flat seam for the pouch of FIG. 1, according to the present inventions.
Figure 2C:
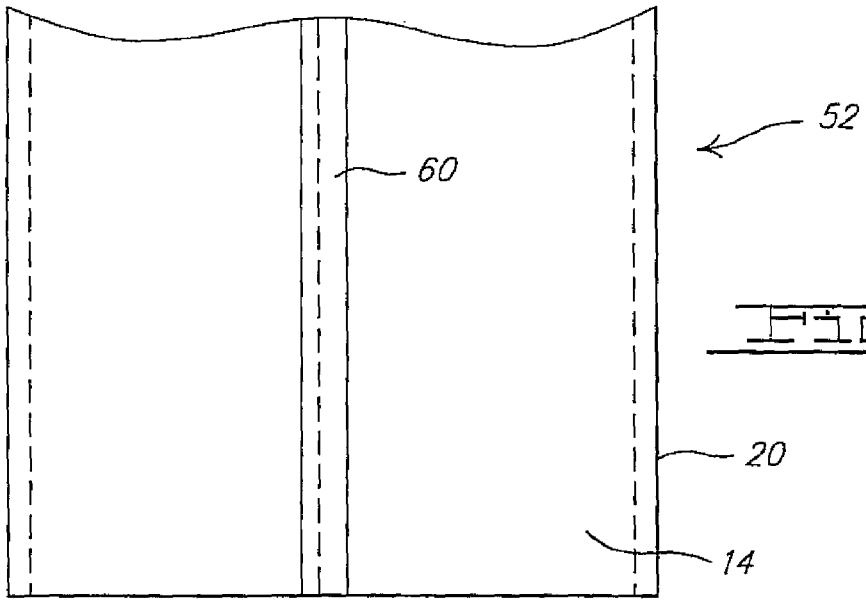
FIG. 2*c* is a partial elevational view of a flexible pouch with a folded flat seam, according to the present inventions.
Figure 5:
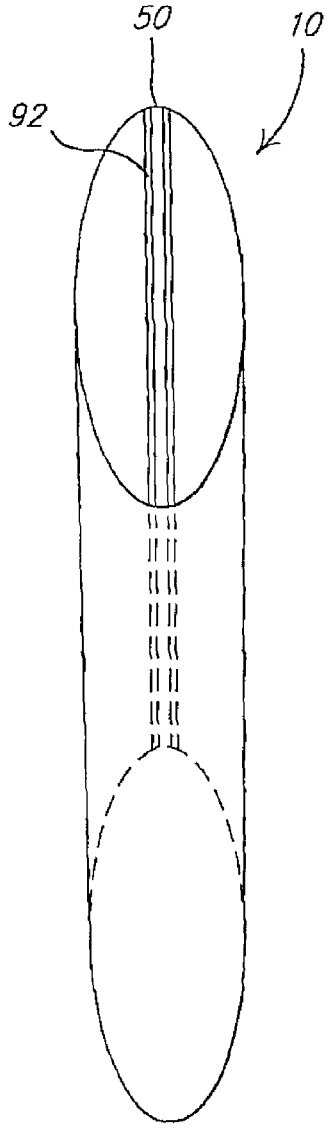
FIG. 5 is a side view of a flexible pouch with a seal strip covering the flat seam, according to the present inventions.

In an embodiment of a pouch 52 illustrated in FIGS. 2*a*-2*c*, the flat seam 50 is a folded seam or reverse seal. A first and second side edge includes a fold, as shown at 54 and 56. The first fold 54 forms an obtuse angle along the first edge and the second fold forms an acute angle 56 along a second edge 56. It should be appreciated that only a minimal portion of the first side edge 54 extends beyond the second side edge 56. The first side edge 54 is positioned over the second side edge 56, so that the folds are in alignment and that a portion of the first side edge 54 extends beyond the second side edge 56, as shown at 58. The first and second edges 54, 56 are sealed together in a manner to be described, and the extending edge 58 is folded over to form a flap 60 that can lie flat against the outer wall of the pouch 52. Preferably, the flap 60 is secured to the outer wall of the pouch 52. For example, the flap 60 may be secured along an upper edge and a lower edge to the walls of the pouch. Alternatively, the length of the pouch may be secured to the walls of the pouch. The flap can be secured using a sealing means, such as a tack seal, or an adhesive or monolayer film or the like. In another alternative, the flap may be sealed to the outer surface of the pouch using a second strip 92 of material covering the seam, as shown in FIG. 5. The seam cover 92 is secured using a sealing means, such as a weld or an adhesive. The folded seal is advantageous, since it has higher seal bond strength than a typical layer on layer seal.

Figure 3:
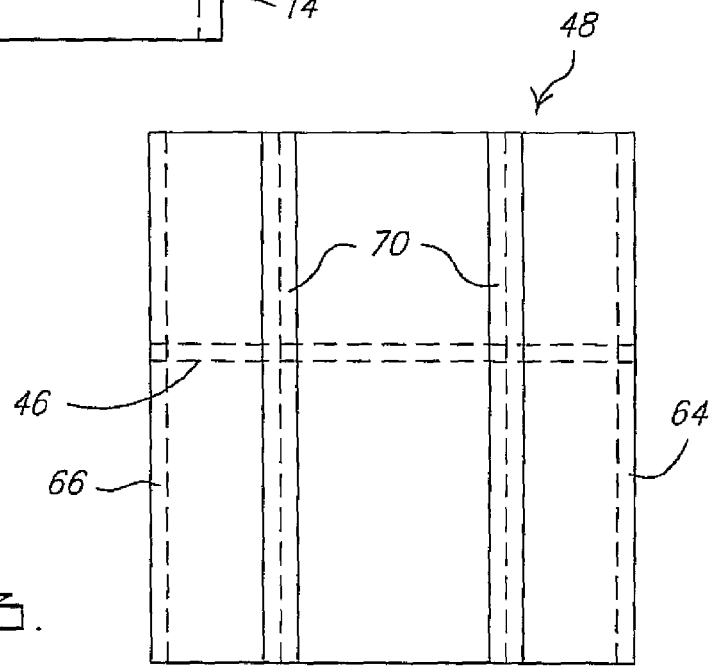
FIG. 3 is an elevational view of a panel with an integrally formed gusset prior to sealing the side edges, according to the present inventions.
Figure 4A:
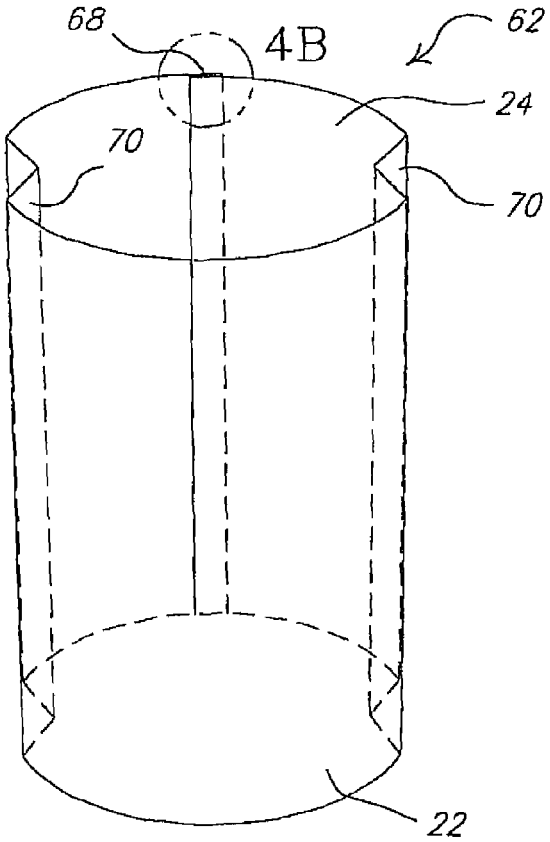
FIG. 4*a* is an elevational view of a pouch having an integrally formed gusset and an overlap flat seam, according to the present inventions.
Figure 4B:
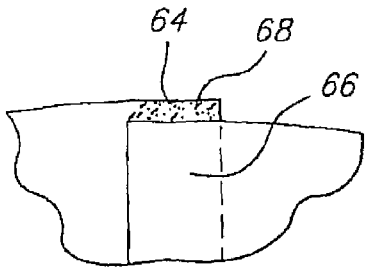
FIG. 4*b* is a detail view of the overlap flat seam, according to the present inventions.

Another embodiment of a pouch 62 with an overlap flat seam is illustrated in FIGS. 3-4. In this example, a first side edge 64 overlaps a second side edge 66 a predetermined amount. Alternatively, each side edge 64, 66 may include a corresponding fold, as shown at 64*a* and 66*b* in FIGS. 18*a*-18*c*. The first side edge 64 is positioned over the second side edge 64 so that the edges overlap. Preferably, the amount of overlap is between 5-12 mm. The first and second edges are sealed together using a technique to be described. It should be appreciated that the inclusion of a CPP layer of material on the inside of the pouch and on the outside improves the seal strength of the overlap seal, since it has higher bond strength and prevents delamination.

Figure 19A:
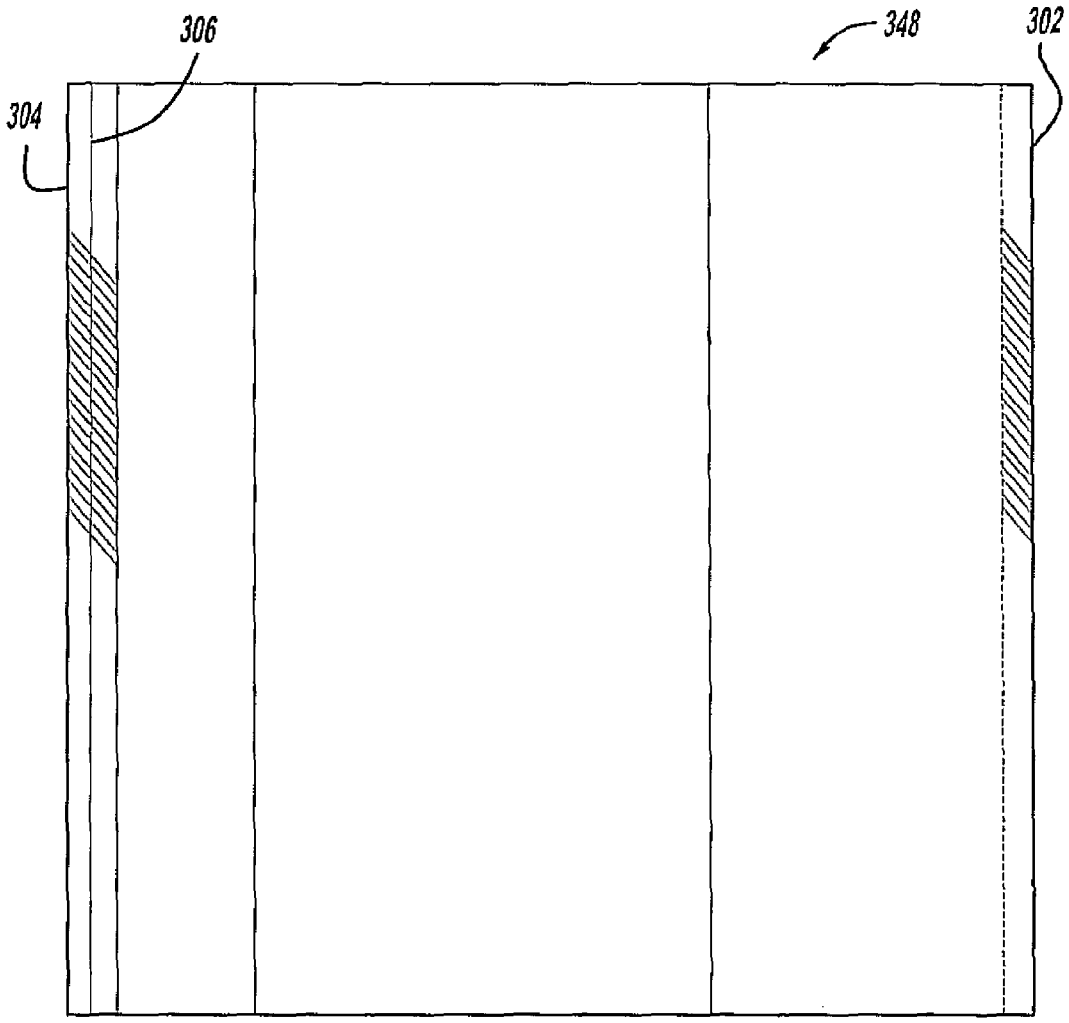
FIG. 19*a* is an elevational view of a panel for a pouch with an overlap S-type flat seam, according to the present inventions.
Figure 19B:
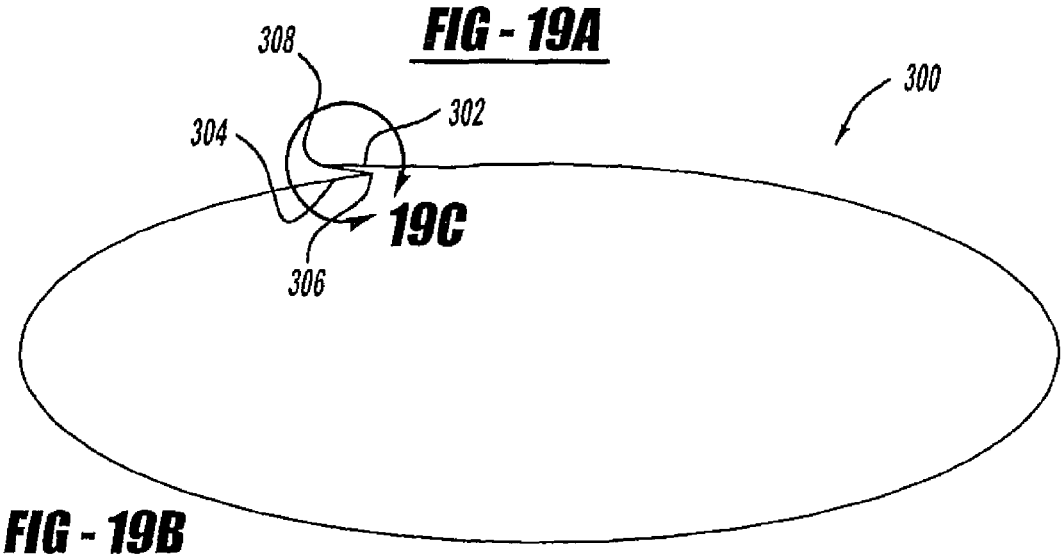
FIG. 19*b* is a sectional view of a pouch formed using the panel of FIG. 19*a*, according to the present inventions.
Figure 19C:
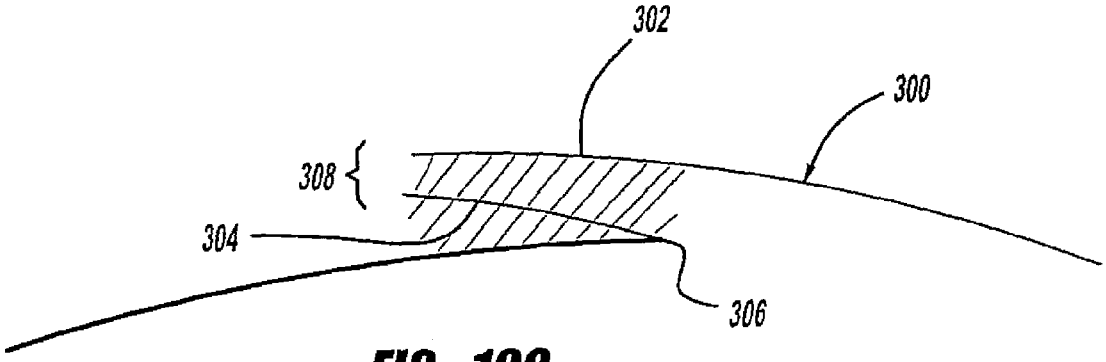
FIG. 19*c* is a detail view of the S-type flat seam, according to the present inventions.

Still another embodiment of a pouch 300 formed from one panel of material 348 and having an overlap flat seam is illustrated in FIGS. 19*a*-19*c*. In this example, a first side edge 302 overlaps a second side edge 304 a predetermined amount. The second side edge includes a fold along a seal fold line, as shown at 306. The first side edge does not include a fold. The second side edge 304 is folded outwardly 180 degrees along the seal fold line 306, and the first side edge 302 is positioned over the second side edge 304 so that the first side edge 302 is adjacent the folded second side edge 304. Preferably, an outer portion of the first side edge and an outer portion of the second side edge are in alignment with each other and shown at 308. Preferably, the amount of overlap between the first side edge and second side edge is about 5-12 mm. The first and second edges are sealed together using a technique to be described. It should be appreciated that the inclusion of a CPP layer of material on the inside of the pouch and on the outside, improves the seal strength of the overlap seal, since it has higher bond strength and prevents delamination. As previously described, a seam cover may be positioned over the seam and sealed to the outer wall of the pouch.

Referring back to the previous figures, the pouch 10 may include an insert, sidewall or gusset 70. The gusset 70 may be integrally formed in the panel 48, as shown in FIGS. 3 and 4, or a separate piece of material. The gusset may be disposed between the front and back walls, and positioned between the side edges of the walls, the lower edges, the upper edges, or any desired combination. It should be appreciated that the shape of the gusset 70 is nonlimiting. For example, the gusset 70 may be generally wider at one end and taper upwardly towards the opposite end. The gusset 70 may also be of a uniform width. The use of the gusset 70 may be functional, i.e. it may allow the pouch 10 to acquire another shape, such as cylindrical, or to stand upright. The gusset 70 also enhances the strength and rigidity of the pouch 10 during filling and processing. A side gusset is advantageous since it allows the walls of the pouch to expand as the internal pressure within the pouch increases. A gusset 70 positioned between the lower edges of the pouch 10 forms a base, which may enable the pouch 10 to stand upright.

Similarly, the pouch may include an insert, as shown in FIGS. 6-9. The insert 72 is a generally planar member that is inserted between the walls 12, 14 of the pouch 10. The shape of the insert 72 is nonlimiting, and generally influences the shape of the flexible pouch. The insert 72 may be positioned internally within the pouch or externally. Various materials may be utilized for the insert, such as foil, cardboard, plastic, nylon, laminate or the like. Further, the insert 72 may be formed from a printed material, or it may be clear. In one example, the insert 72 is inserted between the lower edges of the panel and sealed to the walls of the panel. The seal may be an ultrasonic seal or a heat weld or the like.

Figure 6B:
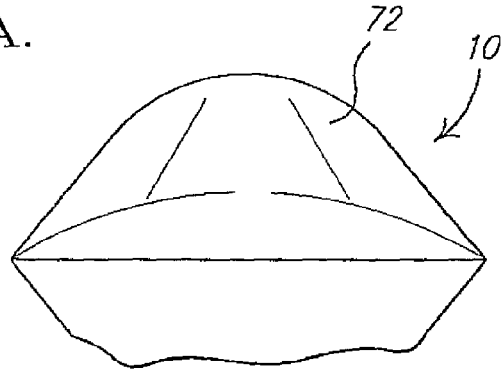
FIG. 6*b* is an end view of the pouch of FIG. 6*a*, according to the present inventions.
Figure 6C:
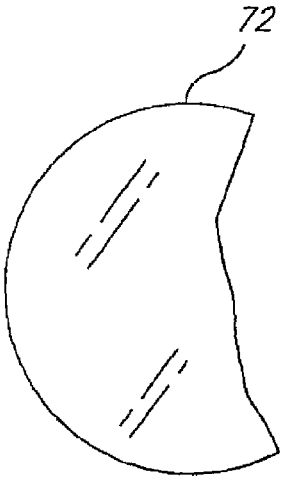
FIG. 6*c* is a partial view of an insert for the pouch of FIG. 6*a*, according to the present inventions.

Referring to FIG. 7, a pouch with two inserts is illustrated. In this example, there is a first insert 72*a* positioned between the lower edges of the panel, and a second insert 72*b* positioned between the upper edges of the panel. The first insert 72*a* may include an integral fitment means, such as a straw hole 80 for receiving a straw. The pouch of this example has a generally square shape. As shown in FIGS. 6*a*-6*c*, the insert has a round shape and the pouch has a tapered shape. Similarly, in FIGS. 9*a*-9*c*, the insert has a square shape and the finished pouch has a tapered shape similar to a bottle.

The pouch 10 incorporates an opening means 74 for accessing the contents of the pouch. Various types of opening means 74 are known in the art for this purpose. It should be appreciated that the opening means 74 may be incorporated into the pouch 10 prior to filling the pouch 10. One example of an opening means is a tear-off portion 76, as shown in FIG. 6. The tear-off portion 76 usually has an integral tear notch 78. The tear notch is typically formed near the upper edge, for accessing the product contained therein although it could be located elsewhere. Another example of an opening means 74 is a weakened, straw-pierceable portion 80 in the pouch for receiving a straw. A further example of an opening means 74 is a pull tab 82 covering an opening in the pouch. Both are illustrated in FIG. 7. Yet another example of an opening means is a resealable zipper, such as a hermetic seal.

Still a further example of an opening means 74 is a removable and replaceable cap 84 secured to a fitment 86. The cap and fitment may be positioned between the upper edges 16 or lower edges 18 of the pouch. The cap 84 screws onto a spout end 88 of the fitment 86. The cap 84 can be the traditional round shape. Alternatively, the cap 84 can have an elongated oval shape so that the pouch may stand up on its own, as shown in FIGS. 11*a*-11*d* and 21-22. The cap 84 and fitment 86 can be made from a variety of materials. For example, the cap 84 may be made from plastic, such as reground resins. The fitment 86 may be made of polypropylene (PP), depending on the product. The fitment 86 is sealed into the upper edges of the panel using a sealing means, such as an ultrasonic seal or a heat weld, or the like. The spout portion of the fitment 86 may include a removable seal 90 to prevent leakage of the product or evidence of tampering.

Figure 20:
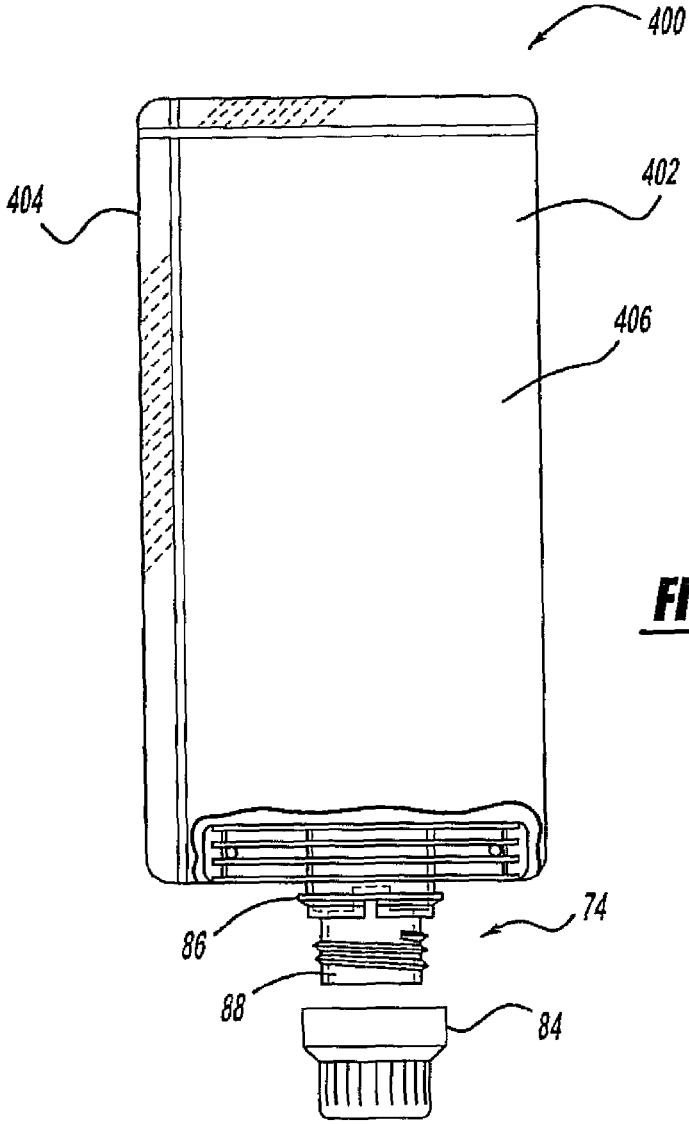
FIG. 20 is an elevational view of an empty ergonomic pouch, according to the present inventions.
Figure 21:
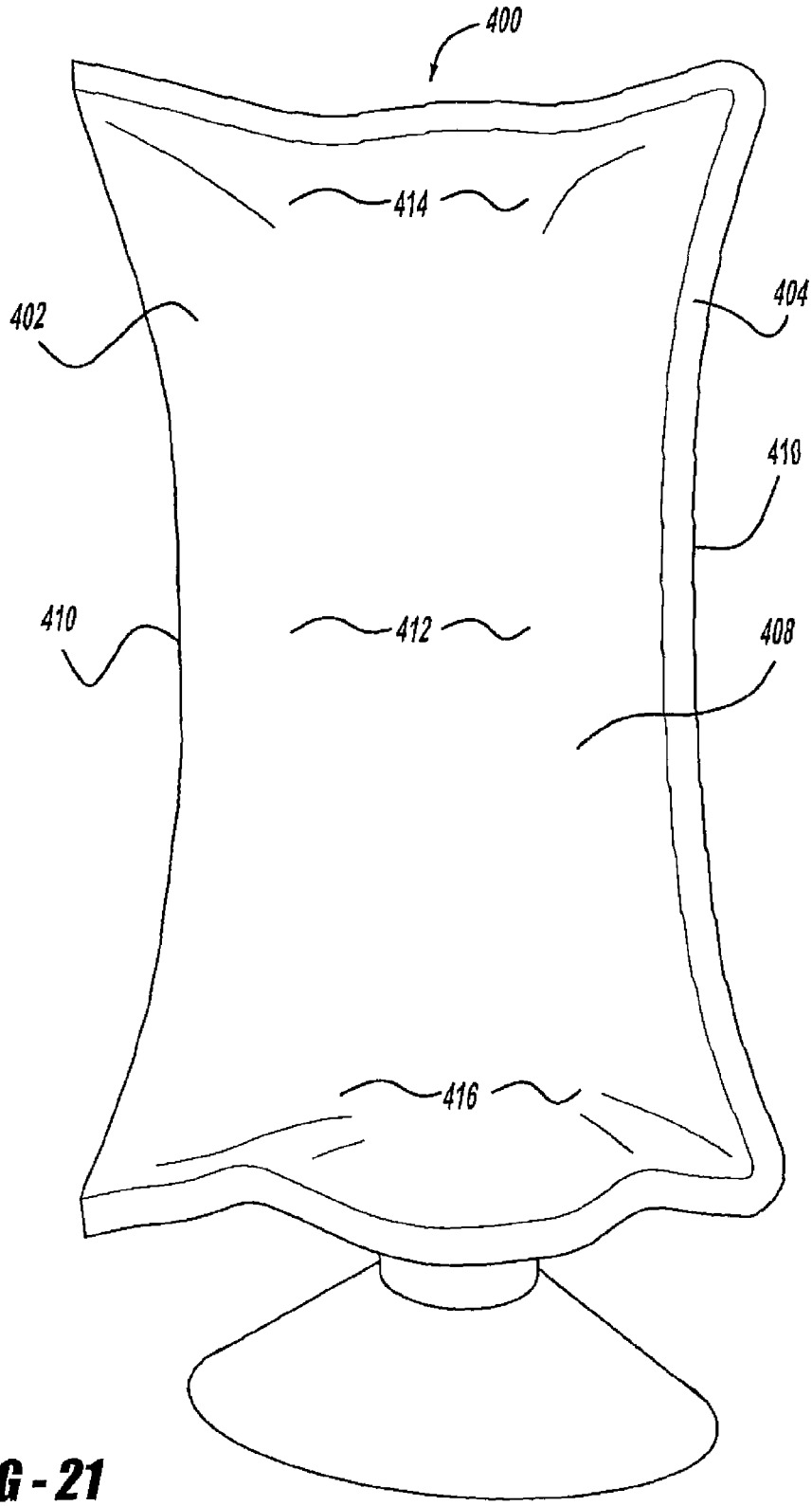
FIG. 21 is an elevational view of the filled ergonomic pouch of FIG. 20, according to the present inventions.
Figure 22:
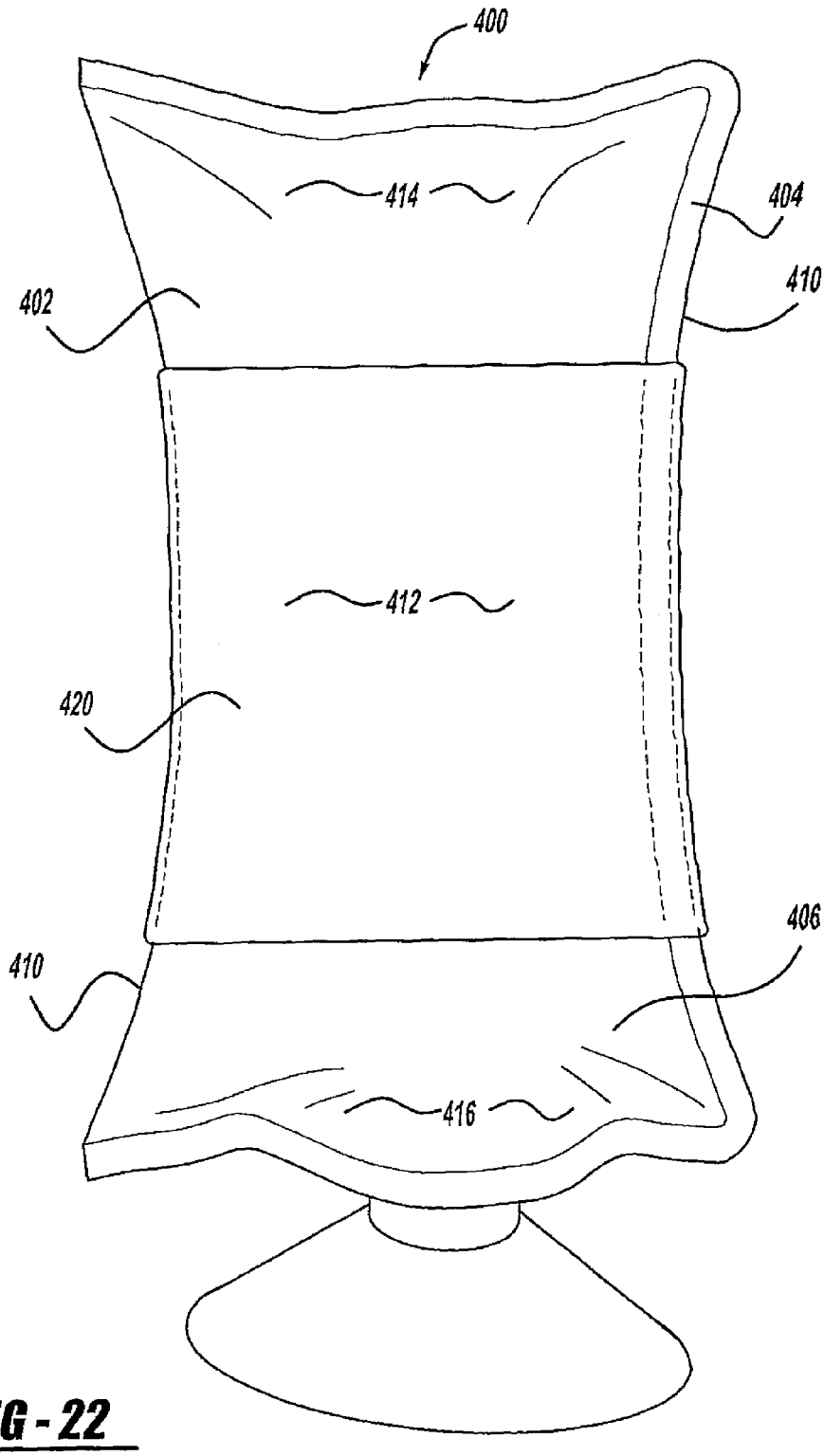
FIG. 22 is an elevational view of the filled ergonomic pouch of FIG. 21 with a sleeve, according to the present inventions.

Referring to FIGS. 20-22, examples of an ergonomic pouch 400 are illustrated. The ergonomic pouch has similar features as the previously described pouches. In this example, the pouch is formed from a single panel of material 402, and the side edges are joined along one side seam 404. The one side seam may be a "fin" style seam, or a flat seam formed as previously described. In this example, a "fin" style side seam is shown. If the pouch 400 is filled with a carbonated product, the carbonation causes the pressure within the pouch to increase. As a result of this increased pressure, the front wall 406 and back wall 408 each assume a longitudinally oriented convex shape, and each side edge 410 assumes a longitudinally oriented concave shape. Thus, the width across the pouch is less in the middle as shown at 412, than at the upper edge 414 or lower edge 416. The overall hourglass shape assumed by the pouch 400 due to the internal pressure within the pouch is ergonomically advantageous.

Referring to FIG. 22, the flexible pouch may include an outer layer or sleeve 420 covering the outer surface of the pouch. The sleeve may be a label containing information about the product, such as a barcode or the like. The sleeve 420 may cover only a portion of the pouch outer surface. Preferably, the sleeve 420 is shrink over the outer surface of the pouch after the pouch is formed and filled with the product. The sleeve is advantageous because it covers the side seam. It also adds one or more layer of material to strengthen the pouch and improve its durability. Various types of material may be utilized for the sleeve, such as paper or plastic including PET or PVC and the choice is non-limiting.

Figure 24A:
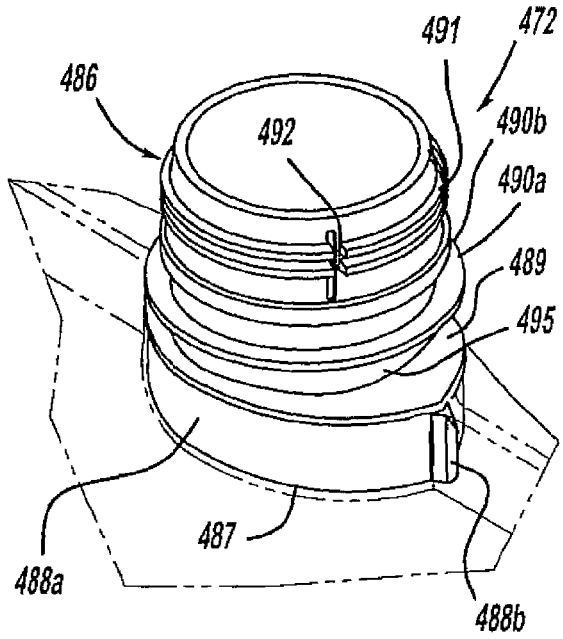
FIG. 24*a* is a perspective view of the spout fitment for a carbonated product for the pouch of FIG. 23, according to the present inventions.
Figure 23:
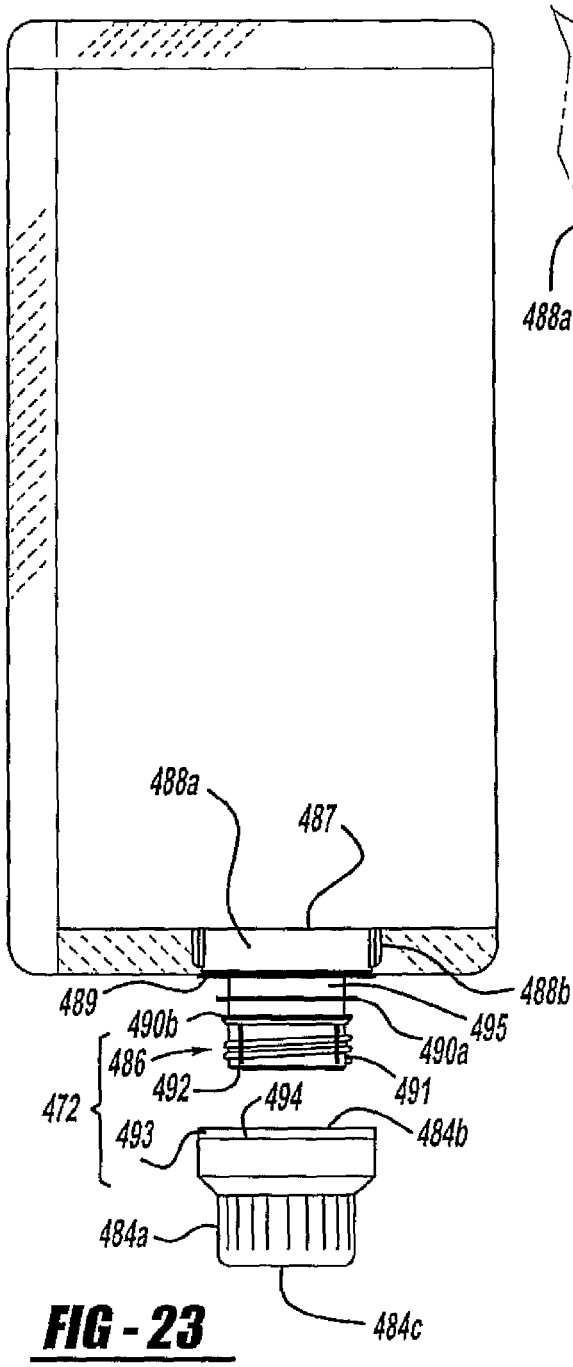
FIG. 23 is an elevational view of an unfilled ergonomic pouch with a fitment for a carbonated product, according to the present inventions.
Figure 24B:
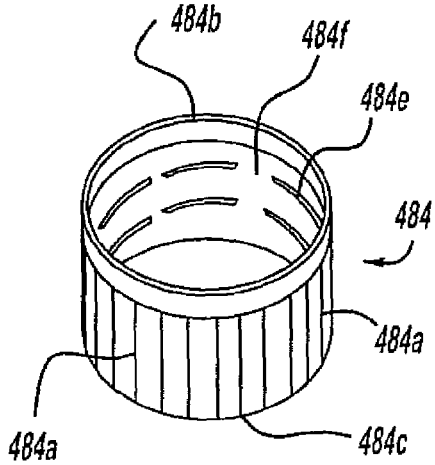
FIG. 24*b* is a perspective view of the cap for the spout fitment of FIG. 24*a*, according to the present inventions.

Referring to FIGS. 23-24*b*, still another example of a flexible pouch with a fitment for preserving carbonation of a carbonated product is illustrated. In this example, an unfilled ergonomic pouch 400 is illustrated by way of example; however, other types of flexible pouches are contemplated. Further, the pouch may assume the hourglass shape previously described, when filled. The fitment 472 includes a canoe-shaped base 487 that is heat sealed between the edges of the pouch, and an upwardly projecting spout 486. A removable and replaceable cap 484 is secured to the spout 486.

The cap 484 and spout 486 can be made from a variety of materials. For example, the cap 484 may be made from plastic, such as reground resins. The spout 486 may be made of PE or polypropylene (PP), depending on the product.

The base 487 or canoe portion of the fitment includes a vertically extending wall 488*a*. In this example, the base portion has an elongated oval shape. The base 487 also includes a pair of sealing ribs 488*b* protruding outwardly from the wall 488*a*. Preferably, one rib 488*b* is positioned on each outermost edge of the base 487. An upper edge of the wall 488*a* includes an integrally formed lip 489 that extends outwardly a predetermined distance. The base 487 is fixedly retained within the flexible pouch when the walls of the pouch are sealed around the base portion using a sealing means, such as an ultrasonic seal. Alternatively, a heat weld, or the like could be utilized to seal the fitment into the pouch. Advantageously, the symmetrical shape of the base portion and protruding lip allows for enhanced precision in positioning the spout between the walls of the pouch during the pouch forming process. During sealing, material flows around the sealing rib 488*b* and fills in any void between the panel wall and the fitment, to increase the retention of the fitment 472 within the panel walls.

The spout 486 also includes at least one outwardly extending flange or collar 490*a*. The flange 490*a* is spaced a predetermined distance above the lip 489, and the space in between provides a tool support surface for a holding means during the manufacturing operation, as shown at 495. For example, the tool support surface 491 is used to support the pouch 400 during manufacturing operations, such as filling, sealing or the like. The spout 486 includes a second flange 490*b* parallel to, and spaced a predetermined distance above the first flange 490*a*. In this example, the first flange extends out farther than the second flange. As such, the first flange 490*a* also serves as a lower "stop" for the cap 484, while the second flange 490*b* serves as an upper "stop" for the tamperproof feature of this cap, in a manner to be described.

The spout 486 includes an elongated thread 491 encircling the outer surface of the tube, just above the second flange. In this example, the thread 491 has a spiral shape. The thread 491 assists in retaining the cap on the spout. The spout includes a plurality of vertically oriented vent channels or grooves 492 that bisect the thread. The grooves 492 are spaced a predetermined distance apart, around the outer surface of the spout. The grooves 492 provide for the controlled release of pressure from within the pouch due to the carbonated product, when the cap 484 is secured to the spout 486. Another feature of the spout is a removable seal (not shown) located on the upper, open end of the spout, to prevent leakage of the product or provide evidence of tampering.

The cap 484 includes a cylindrical member 484*a* having an open end 484*b* for receiving the spout, and a closed end 484*c*. The cap may include a tamperproof feature, which in this example is a detachable collar 493 connected to the cylindrical member 484*a* by a plurality of connecting walls 494. The connecting walls 494 are thin wall sections that break away from the cylindrical member 484*a* upon the application of a force, so that the cap 484 can be removed from the spout 486. The detachable collar 493 is retained on the spout and is held in place between the first and second flanges. The outer surface of the cylindrical member may include a plurality of vertically oriented gripping ribs 484*d* that assist a user in removing or replacing the cap on the spout.

An inner surface of the cylindrical member 484*a* also includes an outwardly projecting thread 484*e*. The thread 484*e* has a spiral shape. The inner surface of the cylindrical member also includes a plurality of vertically oriented vent channels grooves 484*f* that bisect the thread 484*e*. It should be appreciated that the vent grooves 484*f* in the cap 484 are located between the vent grooves 492 in the spout 486, when the cap is screwed onto the spout.

In operation, the cap 484 is initially pushed on the spout 486 and retained by the engagement of the detachable collar between the spout second flange and first flange. To remove the cap, the user grips the cap by the outer surface of the cylindrical member, and twists the cap until the thin wall sections between the cylindrical member and detachable collar are severed. The cap can then be twisted off from the spout. The detachable collar may be retained on the spout, and only the cylindrical member is removable. The cap can be replaced on the spout to reseal the spout. Alternatively, the collar may have a tab that is pulled to sever the connecting walls 70 to remove the cap from the spout.

Figure 25:
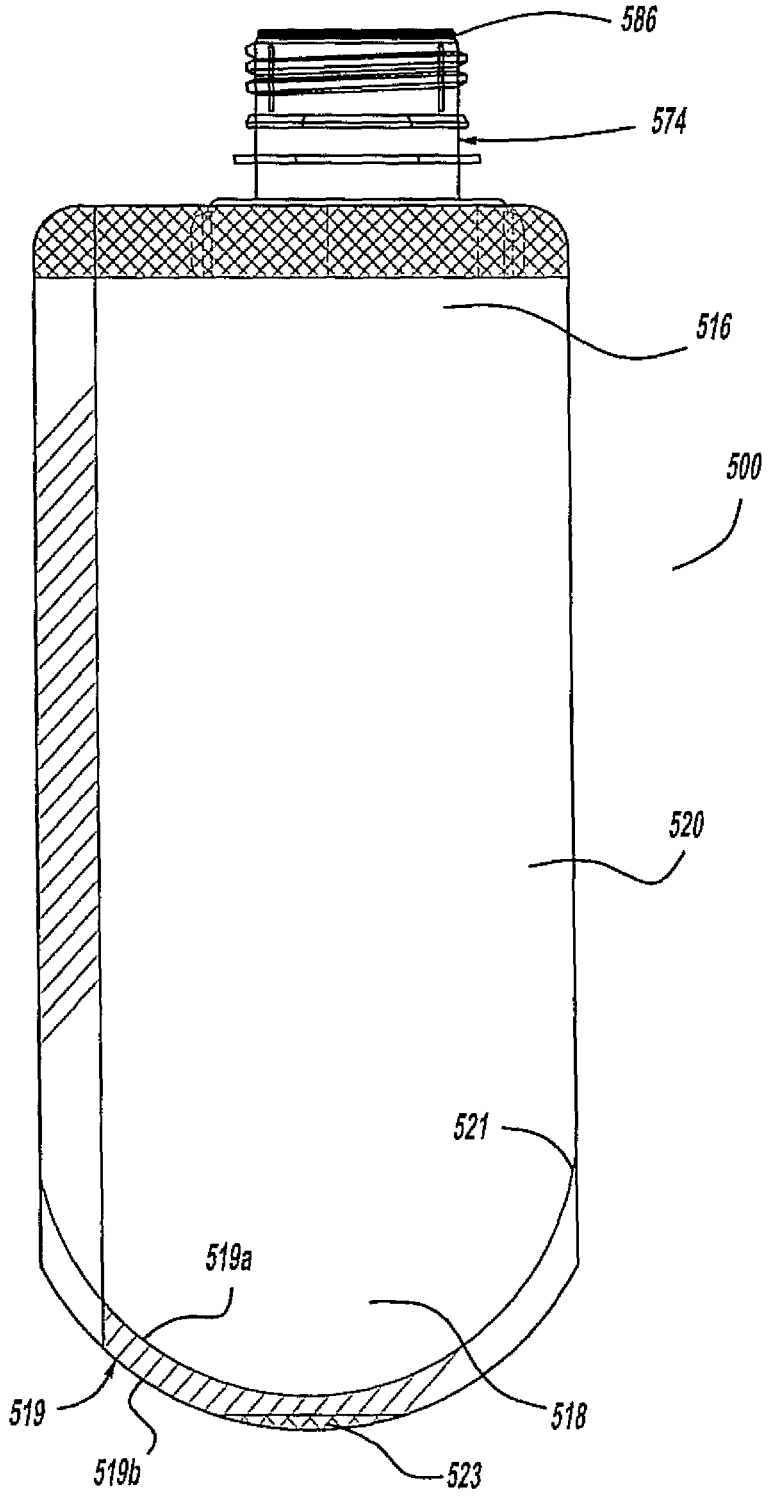
FIG. 25 is a front view of a pouch with a curvilinear lower edge, according to the present invention.

In an example of a pouch 500 illustrated in FIG. 25, the bottom edge 518 of the pouch 500 has a predetermined shape, which in this example is curvilinear. It should be appreciated that like features have like reference numerals increased by 500. In addition, the bottom edge is sealed using a bottom edge seal 519. The bottom seal 519 is a rounded seal having a curvilinear shape corresponding to the shape of the lower edge of the pouch. An inner edge 519*a* of the bottom seal is arcuate, and has a predetermined radius. The bottom seal 519 also includes a lowermost edge 519*b* which is a parallel curve to the inner edge 519*a*, as seen in FIG. 25. The parallel curves of the inner edge 519*a* and the lowermost edge 519*b* define the curvilinear shape of the bottom seal 519. An angle formed at the junction of the side edge 520 and the bottom edge 518 is an obtuse angle as shown at 521. The arcuately shaped inner edge 519*a* of the bottom seal 519 evenly distributes a force from the product contained within the pouch 500 on the bottom seal 519*a*. As a result of the even distribution of forces, the force is not concentrated in one location, resulting in a stronger seal. The curvilinear bottom seal 519 may be a heat seal, an ultrasonic seal, or a combination thereof.

The pouch 500 may include a second partial seal 523 that coincides with a portion of the bottom seal 519. In this example, the second partial seal 526 is located along the lowermost edge 519*b* of the first curvilinear bottom seal 519. The second partial seal 523 extends a predetermined length, and has a predetermined width. The width and length of the second partial seal 523 is less than the corresponding width and length of the first seal 519. The second partial seal 523 may be a cosmetic seal, a heat weld or an ultrasonic seal and enhances the security of the curvilinear bottom seal 519.

Figure 26:
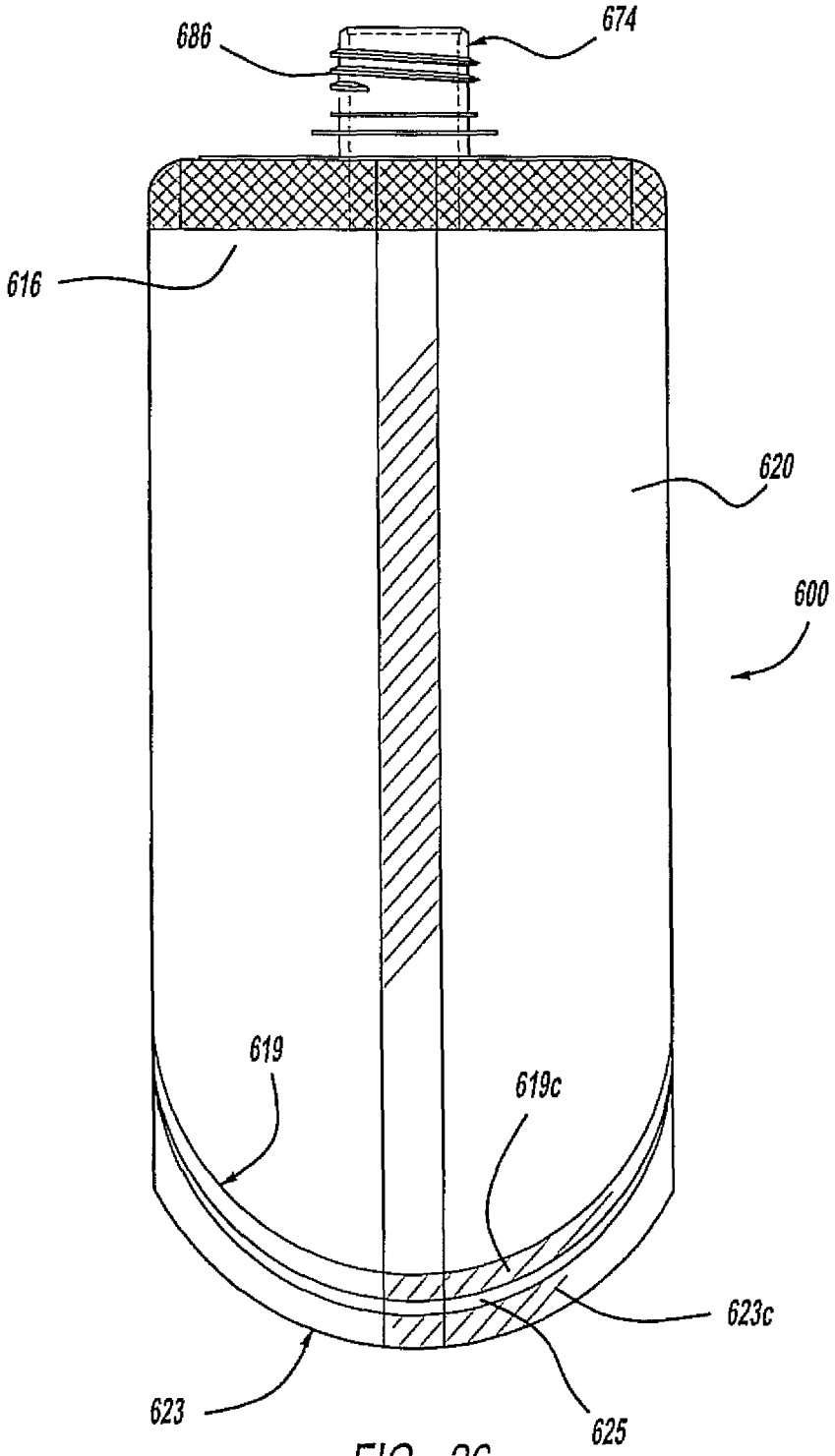
FIG. 26 is a front view of another example of a pouch with a curvilinear lower edge, according to the present invention.

In still another example of a pouch 600 illustrated in FIG. 26, the pouch 600 includes two bottom seals 619, 623 spaced a predetermined distance apart, so that there is an air pocket 625 formed therebetween the first bottom seal 619 and the second bottom seal 623. The width of the first bottom seal 619 as shown at 619*c* may be greater than the width of the second bottom seal 623, as shown at 623*c*. The second bottom seal 623 provides a security feature for the pouch 600 if the first bottom seal 619 bursts, since the air pocket 625 disperses the force from the product and reduces the force exerted on the second bottom seal 623. The security of the second bottom seal 623 is enhanced since any remaining force is distributed along the second bottom seal 623. The second bottom seal 623 has generally the overall length of the first bottom seal 619.

Any of the flexible pouches described herein may incorporate any of the above-described features in any combination. For example, any of the pouches may include an insert 72 in the bottom portion of the pouch and a tapered top portion, or an insert 72 in the bottom portion of the pouch and a fitment and cap in the top portion of the pouch, or an insert 72 in the bottom portion and the top portion of the pouch. The flexible pouch may include any one of the described opening means. In addition, the finished pouch may assume various shapes, such as cylindrical, cubical, and conical, hourglass or the like, as influenced by the type of product and intended usage of the pouch. The finished pouch may have a curvilinear shaped bottom edge.

It should be appreciated that any of the above-described flexible pouches may advantageously include other features that are known in the art. For example, the flexible pouch may include a guide pocket formed in a wall of the pouch prior to filling and sealing, to facilitate the separation of the front and back walls prior to the filling of the pouch. An example of such a pouch is disclosed in commonly assigned U.S. patent application Ser. No. 10/310,221.

It is also contemplated that any of the described pouches may undergo a secondary process after it is filled with the product. For example, the filled pouch may be frozen. Alternatively, the filled pouch may be pasteurized in order to have an extended shelf stable life under ambient temperature. Examples of pasteurized food products include dairy products such as milk, or meat products such as chicken or the like.

Figure 12:
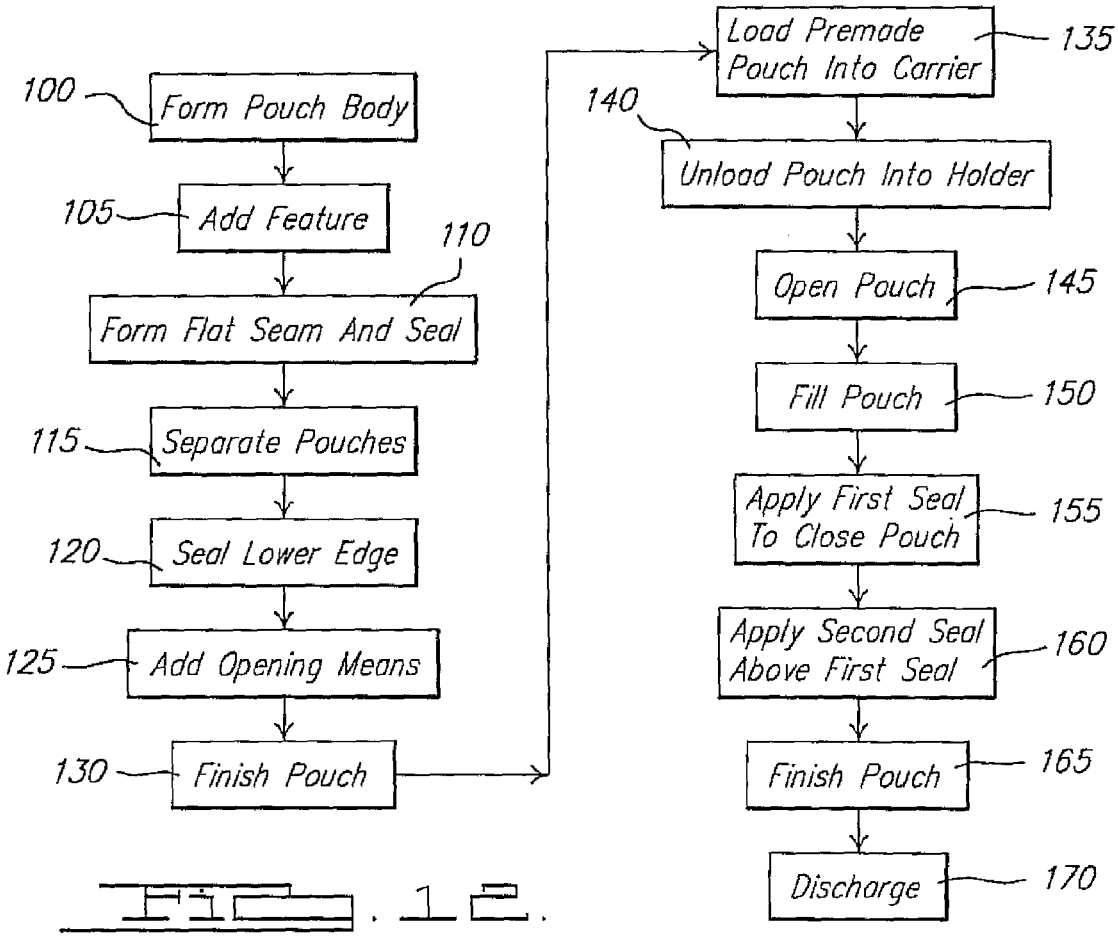
FIG. 12 is a flowchart of a method of forming a flexible pouch with a flat seam, according to the present inventions.
Figure 13:
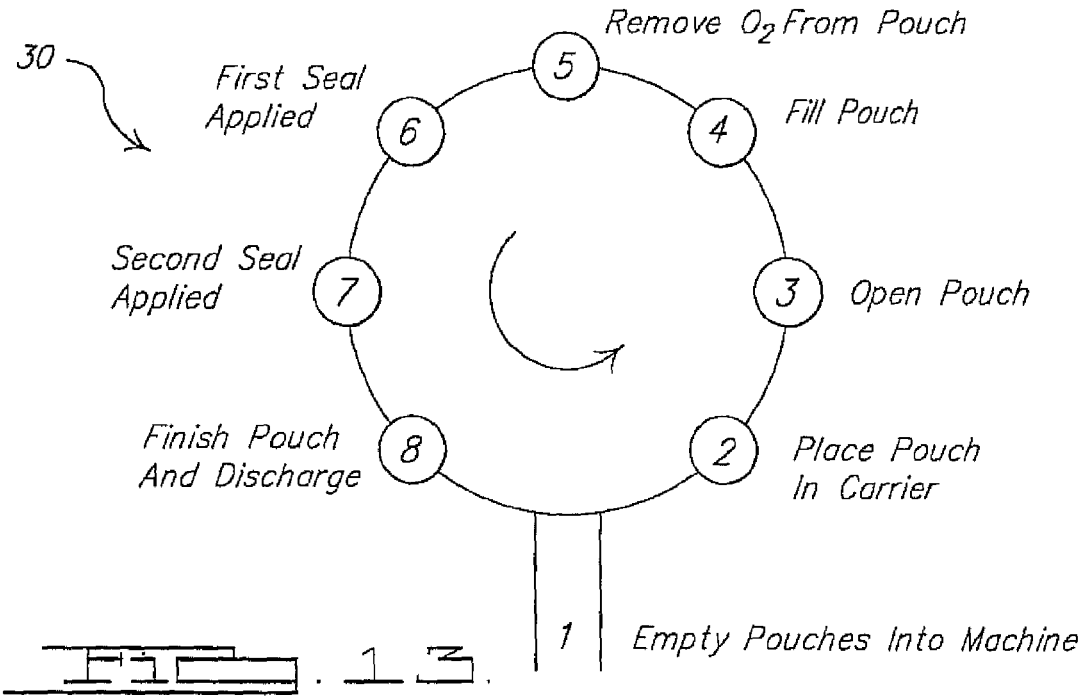
FIG. 13 is a schematic top view of a rotary fill machine according to the present inventions.

Referring to FIG. 12, a method for forming and filling any of the previously described flexible pouches using a high-speed machine, such as that described with respect to FIGS. 13-16, is illustrated. The method is applicable to any of the flexible pouches described above, by way of example. The method begins in block 100 at a first station with the step of forming the body of the pouch. For example, a roll of laminate material, as previously described, is unrolled along a horizontally oriented plane. The initial width of the roll of material is determined by the desired finished size of the pouch 10 and the number of pouches to be obtained from the width. In an example, three or four or more pouches, representing corresponding panels, can be obtained from a width of the roll of material on a three, four or multiple lane machine, respectively. Each panel 48 has an inner surface 24 and an outer surface 22. One layer of the material is preferably preprinted with information or locating indicia (not shown), such as a registration mark. The registration marks are located on the material to denote an edge of a wall 12, 14. The registration marks are read by an optical reading device (not shown), such as a scanner, to index the material in a predetermined position at the cutting station. The preprinted information may include labeling information that describes the product contained within the pouch. In this example, the layer of preprinted information is located on an outer layer of the material. The step of forming the body of the pouch may include separating the material into the panel for a pouch. It may also include folding the panel to acquire the general shape of the pouch.

The methodology advances to block 105 and a feature, such as a gusset 70 or insert 72, is optionally positioned with respect to the unrolling material. In addition, an opening means may be applied at this time. For example, an opening means 74, such as a press-to-close zipper, may be positioned with respect to the panel representing the pouch. Another opening means such as a straw hole, patch or tear notch may be applied to the panel representing the pouch.

The methodology advances to block 110 and the edges of the panel, such as an upper edge, a lower edge or a side edge are sealed together to form a seam 50. The edges may be sealed using an ultrasonic sealing process, or by a heat weld that includes the application of heat and compression, or a combination thereof.

If the pouch includes a folded flat seam 52, a fold is formed along an edge of the sheet of material, and the edges are sealed. The angle of the fold is determined, according to the width of seam desired, as previously described. The fold in the first edge 54 is aligned with the fold in the second side edge 56 and the edges are sealed together, in a manner to be described. The extending edge 58 is folded over to form the flap and sealed. At least a portion of the flap may be secured to the outer portion of the material.

If the pouch includes an overlap flat seam 68, the edges of the sheet of material are positioned together, such that a first edge 64 overlaps a second edge 68 a predetermined amount, and the edges are sealed together. To form an overlap flat seam as shown in FIGS. 19*a* and 19*b*, the second edge is folded outwardly along a seam line. The first edge is positioned over the second edge a predetermined overlap amount. The outer portion of the first edge and the outer portion of the second edge are in alignment. The edges are sealed together as previously described. With either of these types of flat seams, a second strip of material 92 may be positioned over the seam and sealed onto the wall of the pouch. Various additional techniques are contemplated for sealing the edges together. For example, an adhesive may be used to seal the first and second edge of the flat seam together.

The edges may be sealed using a seal bar or forming plate, and the seal bar or forming plate may have a plasma coating. One advantage of the plasma coating is that the line speed may increase. Another advantage is that the coating makes the surface of the seal bar or forming plate more resilient. When the seal bar is heated, the coating expands due to this resiliency. The shear stress on the inner edge of the seal is reduced; resulting in reduced creepage of the material and greater durability of the seal. The plasma coating reduces the opportunity for potential damage to the material during the sealing step. In this example, the plasma coating is a smooth, hard plastic that mimics glass. Since the outer layer of material is not weakened, there is no creepage of the outer layer.

The edge may be sealed using a two-step seal, as shown in FIG. 20. The two-step seal advantageously avoids the generation of ketones that occur due to application of heat to the material. The first or inner seal is a low temperature seal. The second or outer seal is a high temperature seal. The second seal is spaced apart from the first seal by a predetermined distance, to create an air gap. The first seal is a tack seal, such as 6 mm wide, and is of a sufficient temperature so as to melt the layers of material and tack the edges together. The predetermined distance between the first and second seal is ½-1 mm. The second seal is applied at a higher temperature and pressure than the first seal. As a result, any gas, such as steam, ketones, aromatics or the like are pushed in an outwardly direction, out through the open edges of the panels, and not into the pouch. Thus, the first seal prevents entry of contaminates into the pouch to avoid organoleptic contamination. In this example, the overall seal is about 10 mm in width. For example, the first seal is at a low temperature and high pressure for approximately 0.5 seconds. The second seal is at a high temperature and high pressure for approximately 0.8 seconds. A cold seal may be applied over the earlier first and second seals that is a cool seal at a temperature and at a high pressure for about 0.9 seconds. The resultant seal is advantageous since it avoids stress lines and does not require a cosmetic seal.

The methodology advances to block 115, and the section of pouches formed in the roll width of material are separated from each other in a cutting operation. For example, each section of material may be first separated along its width, i.e. along the side seam of the pouches. The section is then separated into individual pouches. In this example, the width of unrolling represents the side edges. The material is cut using a known cutting apparatus, such as a laser or punch or the like. The material is cut into a pouch 10 using a known cutting apparatus, such as a laser or punch or the like. The cutting apparatus forms a single cut in the material to separate the pouches. The length of the pouch 10 is controlled by the distance between the cuts.

Alternatively, two pouches 10 are cut out at one time by adding a double cut between two cuts, preferably in the center. Advantageously, forming two pouches during the cutting operation effectively doubles the assembly line speed.

It should be appreciated that the upper edge or lower edge may be further trimmed. For example, the end of the pouch may be trimmed to accommodate a fitment 86. In another example, two legs are formed during the trimming operation, in order to recess the fitment. The fitment may be ultrasonically sealed to the pouch.

The methodology advances to 120, and an edge is sealed, such as the bottom edge 18. The bottom edge 18 may be sealed using a known sealing process, such as an ultrasonic sealing process. Another sealing technique is a heat weld that involves the application of heat and compression. As previously described, the seal bar may have a plasma coating. If the pouch 10 includes a first and second curvilinear bottom seal 519, 523 or 619, 623 respectively, the first bottom seal 519, 619 is applied, and then the second bottom seal 523, 623 is applied. In the example of FIG. 26, the second bottom seal 623 is spaced a predetermined distance outboard from the first bottom seal 619 so that an air pocket 625 is formed therebetween. In the example of a pouch 500 having a second partial seal 523 that is coincident with the first bottom seal 519, the first seal is applied. The second partial seal 523 may be applied at this time, or later in the form process.

In addition, the flap 60, if present, for a folded flat seam 62 may be tacked down to the outer wall of the pouch, such as at an upper or lower end of the center seam. The flap is held in place such as by using an adhesive, or sealed while applying the heat weld or ultrasonic seal. It should be appreciated that the outermost layer of the pouch material may be coated with a heat sealable material to assist in securing the flap to the outer wall of the pouch 10.

The methodology advances to block 125 and an opening means 74 may also be applied to the pouch 10 at this time. For example, a fitment, as previously described, may be sealed within the walls of the pouch 10, such as between the upper edges 16. The fitment may be sealed using an ultrasonic seal, or a heat weld, or by a combination of ultrasonic seal and heat weld. For example, the base portion 487 of the fitment 472 is sealed between the walls of the pouch using an ultrasonic seal, a heat seal, and then a cool seal. The heat seal melts a layer of the pouch material, and the material flows around the sealing ribs 488 on the base portion 487, and fills in any void between the base portion 487 and the wall of the pouch. The cool seal sets the seal and provides an attractive finish to the overall seal. Advantageously, fewer stations are required to seal the fitment between the walls of the pouch, since a tack seal is eliminated.

In addition, an insert 72 may be likewise applied to the pouch 10 at this time. The insert 72 may be positioned at a lower edge of the pouch, an upper edge, or both an upper and lower edge. The methodology advances to block 130.

In block 130, the individual pouches are finished. For example, a lower edge of the pouch 10 may be trimmed to shape, i.e. the corners may be angled. This operation may be performed using a cutter or a die cut or the like.

In another example of a finishing operation, a crease or guide pocket may be formed in a top portion of each wall 12, 14 in a creasing operation, in order to facilitate opening and filling of the pouch. An example of a method of forming a crease in a wall to facilitate opening the pouch is disclosed in commonly assigned U.S. patent application Ser. No. 10/310,221, which is incorporated herein by reference. It should be appreciated that the shape of the finished pouch is non-limiting, and may be round, square, oval, triangular or the like. In still another example of a finishing operation, the sleeve is applied over the individual pouch and shrunk to fit using an application of heat to the pouch.

The methodology advances to block 135 and the pre-made pouch 10 is then transported to the filling machine. The completed pouch may include any combination of the previously described features. Further, the completed pouch may be filled through an open edge, i.e. upper or lower, or through the fitment. The pouches may be loaded into a carrier and transferred to a filling machine. It should be appreciated that the filling machine may be integral with the pouch forming machine, or a separate machine. This portability increases the flexibility of the pouch and may result in a manufacturing cost savings.

The methodology advances to block 140, and the pouch is unloaded from the carrier and placed in a holder for moving the pouch between stations. An example of a holder is a cup-shaped member, as disclosed in commonly assigned U.S. patent application Ser. No. 10/336,601, which is incorporated herein by reference. Alternatively, the pouch 10 may be held using grippers (not shown) as is known in the art. The methodology advances to block 145.

In block 145, the pouch 10 is opened in an opening operation. Various techniques are conventionally known in the art for opening the pouch 10, and may depend on whether the pouch is filled through the fitment or the open edges of the pouch. For example, the guide pocket formed by the crease in the front wall 12 and back wall 14 facilitates opening of the pouch. A nozzle (not shown) may be mechanically lowered into the guide pocket to direct a stream of compressed gas into the guide pocket, to force the walls of the pouch 10 away from each other. An example of a gas is carbon dioxide or nitrogen, or the like. The blowing station may include a manifold, with a hood extending over the top of the edges of the pouch as known in art. The manifold has rows of apertures (not shown) formed above the upper edges 16 of the pouch 10. The hood is placed over the pouch 10 to assist in maintaining the air pressure in the pouch 10. The supply of pressurized gas is directed through the aperture to form a plurality of jets of pressurized gas or air. The jets are directed downwardly at the diamond-shaped openings formed at the upper edges 16 to assist in overcoming the surface tension of the pouch and assist in separation of the walls 12, 14. A diving rod (not shown) may then be used to make sure the pouch 10 is fully opened. If the pouch has a fitment, the gas is injected through the spout fitment. After the pouch is opened, it may be injected with super-saturated steam to eliminate any pathogens or the like. The methodology advances to block 150.

In block 150, the pouch 10 is filled with the product in a filling operation. For example, a fill tube (not shown) is lowered into the opened pouch 10 and the product is dispensed into the open pouch 10.

If the product is naturally carbonated, such as beer or soda or the like, the pouch is preferably filled while immersed in a nitrogen atmosphere. If the product is not naturally carbonated and carbonation is desirable, it is immersed in a carbonator to introduce carbon dioxide into the product. For example, carbon dioxide is introduced into cold water or juice to provide a carbonated beverage. The product may contain a mixture of up to four volumes of carbon dioxide. It should be appreciated that the carbon dioxide masks any undesirable taste from ketones and other solvents released during the sealing process. The carbon dioxide also increases the pressure within the product so that the walls of the pouch are rigid after the top is sealed. The product is preferably filled at a temperature ranging from 29° F. to ambient temperature. The methodology advances to block 155.

In block 155, the filled pouch is closed. The filled pouch may be closed by applying a closing seal, or a cap to a fitment or the like. For example, the closing seal may be an ultrasonic seal, or an ultra pulse seal, or a heat weld or the like. In an example of a pouch filled through an open edge, the open edge of the pouch 10 is closed by applying a closing seal. The open edge may be the top edge, the bottom edge or the side edge. As shown in FIG. 26, the curvilinear bottom edge 19 may be sealed using the closing seal 623 described herein.

If the pouch holds a carbonated beverage, the closing seal may be the seal as described in commonly owned PCT Patent Application No. PCT/US03/034396 which is incorporated herein by reference. For a carbonated beverage, the first seal 94 is an ultrasonic seal or an ultra pulse seal. In block 160, a second seal 96 is applied outboard of the first seal 94. The second seal may be a heat weld. Some of the product may be trapped between the first and second seals 94, 96. This is advantageous since there is no gas in the head space, i.e. the region between the product and the heat seal, and less pouch material is required. A cosmetic seal may be applied above the first and second closing seals.

In an example of a pouch filled through the spout fitment, the cap is applied to close the pouch. The cap may be a tamper-evident cap for a carbonated product, as previously described. The cap contains the product in the filled pouch, to prevent leakage of the product from the pouch. The complementary arrangement of threads and grooves in the cap and spout provides for the controlled release of pressure from the pouch.

The methodology advances to block 165 and the pouch 10 is finished in a finishing operation. For example, the edges 16, 18, 20 of the pouch 10 are trimmed to achieve a predetermined shape. In addition, the pouch 10 may be cooled at a cooling station, where the pouch 10 is cooled using a conventionally known cooling technique. Optionally, the sleeve may be placed over the filled pouch and shrunk to fit over the pouch by applying heat. The sleeve layer forms an outer layer of the pouch. The methodology advances to block 170.

In block 170 the filled pouch 10 is discharged from the machine. A plurality of pouches may be placed in a package for sales or shipping purposes.

It should be appreciated that the pouch may undergo other processing steps, such as such as an upstream oxygen purging station, downstream oxygen purging station, pasteurization or the like. For example, the filled pouch 10 may be pasteurized in integral retort chamber (not shown) that heats and then cools the pouch 10. The pouch 10 may be tested, such as burst testing or the like, prior to packaging for shipping. These additional processing steps may take place at a station on the form/fill/seal apparatus, or on another apparatus.

It should be appreciated that the order of steps may vary depending on the pouch and its features. Also, a particular manufacturing station may perform one or a plurality of operations, to enhance the efficiency of the methodology and apparatus.

Referring to FIGS. 13-16, an example of a fill-seal machine 30 for carrying out the method described with respect to FIG. 12 is illustrated. The fill machines illustrated are by way of example, and other configurations may be utilized. It should be appreciated that a particular manufacturing station may perform one or more operations. It should also be appreciated that the order of operations may vary. The fill-seal machine 30 may be configured as a flat bed, a conveyor, a rotary turret or the like. An example of a flat bed form machine is manufactured by Nishibe, such as the model number SBM500, SMB600 or SMB700. It should be appreciated that the fill-seal machine may be integral with the form machine, or a separate machine.

In operation, the carrier with the pouch is loaded onto the machine 30 as shown at "1". The pouches 10 are removed from the receptacle and placed in a holder as shown at "2", such as by using a gripper.

The pouch 10 is transported along the conveyor belt to operation "3", and the pouch 10 is opened in an opening operation. Various techniques are conventionally known in the art for further opening the pouch 10. The guide pocket formed by the crease in the front panel and back panel facilitates opening the upper edges of the pouch. For example, a nozzle may be mechanically lowered into the pouch to direct a stream of compressed gas downwardly into the pouch to force the walls of the pouch away from each other to further open an upper edge of the pouch. An example of a gas is carbon dioxide or nitrogen. The lever arms assist in maintaining the pouch in an open position.

The pouch 10 is then fully opened. For example, a blowing station may include a manifold, with a hood extending over the top of the edges of the pouch. The manifold has rows of apertures (not shown) formed above the upper edges of the walls of the pouch. The hood is placed over the pouch to assist in maintaining the air pressure in the pouch. The supply of pressurized gas is directed through the aperture to form a plurality of jets of pressurized gas or air. The jets are directed downwardly at the diamond-shaped openings formed at the upper edges to assist in overcoming the surface tension of the walls and assist in separation of the walls. A diving rod may then be used to make sure the pouch is fully opened.

The opened pouch is transferred to a filling station as indicated at operation "4", and the pouch is filled with the product. For example, a nozzle dispenses a predetermined amount of product into the opened pouch. The product may be dispensed into the opened edges of the pouch or through a fitment. In this example, the fill nozzle is lowered into the opened pouch, and the product is dispensed into the open pouch. Depending on the size of the pouch, there may be two fill stations.

If the product is naturally carbonated, such as beer or soda or the like, the pouch is preferably filled while immersed in a nitrogen or carbon dioxide atmosphere. The pouch may be flushed with nitrogen or carbon dioxide or a mixture of both. If the product is not naturally carbonated, it is immersed in a carbon dioxide process to introduce carbon dioxide into the product. For example, carbon dioxide is introduced into cold water or juice to provide a carbonated beverage. The product may contain a mixture of up to six volumes of carbon dioxide. It should be appreciated that the carbon dioxide masks any undesirable taste from ketones and other solvents released during the sealing process. The carbon dioxide also increases the pressure within the product so that the walls of the pouch 10 are rigid after the top is sealed. The product is preferably filled at a temperature ranging from 29° F. to ambient temperature. The carbonation is advantageous as a microbiocide which can enhance the flavor or prevent mold or contamination.

The pouch 10 is transferred to a station "5" for removing any oxygen from the pouch. The headspace of the pouch may be flushed with a gas. The pouch is then transferred to a sealing station and the open edges of the pouch are first sealed, as indicated at operation "6". For example, at the sealing station "6", the lifting surface ends, causing the lever arms to return to their original position, and the pouch to close. It should be noted that the filled pouch might return to a partially closed position due to the product contained therein. The first seal may be a thermal seal. For example, a heat-sealing member extends therethrough the slots in the sides of the cup, to seal the upper edge of pouch. As previously described the heat sealing member may have a plasma coating.

Another example of a first seal for a carbonated product utilizes an ultrasonic sealing process. Preferably the ultrasonic seal includes sound waves and is formed using a horn and anvil. A second seal is applied at a second sealing station "7". The second seal may be applied using a heat seal means to form a second heat seal over the first seal. It should be appreciated that the second seal may be spaced slightly above the first seal. The second heat-sealing station is conventional and utilizes heat or a combination of heat and pressure to form the seal. The second seal may also be a cosmetic seal or another type of seal, such as ultrasonic, ultra pulse or the like. The first and second seals are applied for a carbonated product as disclosed in commonly assigned Patent Application No. PCT/US03/34396, which is incorporated herein by reference. The first and second seals can be the previously described first bottom edge seal and second bottom edge seal for a pouch having a curvilinear bottom edge.

If the pouch is filled through the fitment, the pouch is closed by securing a cap to the fitment. The cap may have a tamper-evident feature. The cap and fitment preferably have leak-proof features as previously described for a carbonated product.

The pouch is transferred to a finishing station as shown at "8" for finishing and removal from the filling machine. For example, the pasteurized pouch 10 may be cooled. A tear notch may be formed in the pocket portion of the pouch to facilitate opening the pouch to access the product in the pouch. In another finishing operation, the edges of the pouch are trimmed to achieve a desired shape. The finished pouches may be discharged into a package. For example, grippers may be utilized to place the pouch in a box for shipment.

If desired, the pouch may be transferred to a pasteurization station. Pasteurization enhances the shelf life of the product. The pouch is inserted into an enclosed retort chamber Air is extracted from the chamber, such as using a vacuum source. The product inside the pouch is pasteurized. For example, a combination of steam and water is used to heat the pouch to a predetermined temperature for a predetermined period of time to pasteurize the product contained within the pouch. The package is then cooled. In this example, recirculated water surrounds the pouch to cool the pouch. In certain instances, it may be desirable to apply steam to sterilize the pouch 10 and to wet the inner surface of the walls to facilitate handling.

Figure 14:
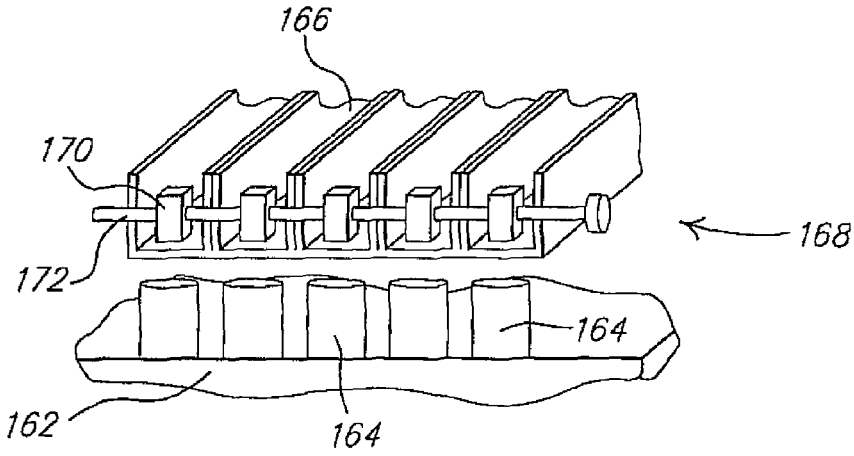
FIGS. 14-16 are examples of fill machines according to the present inventions.
Figure 15:
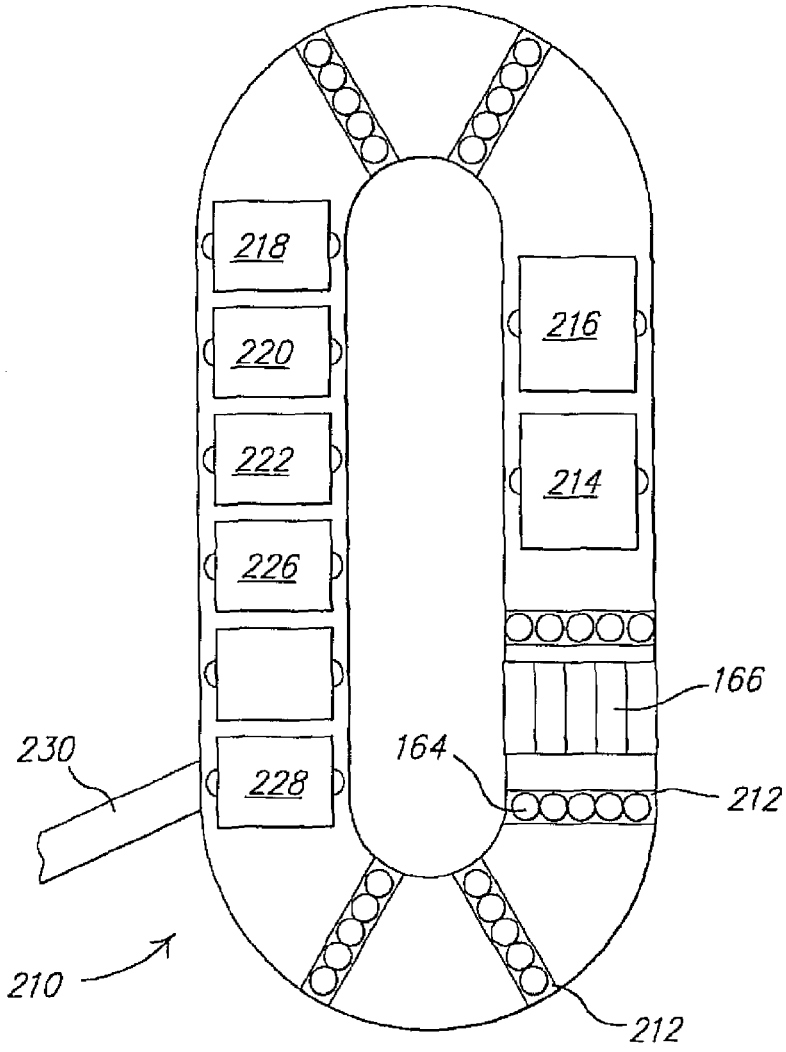
Figure 16:
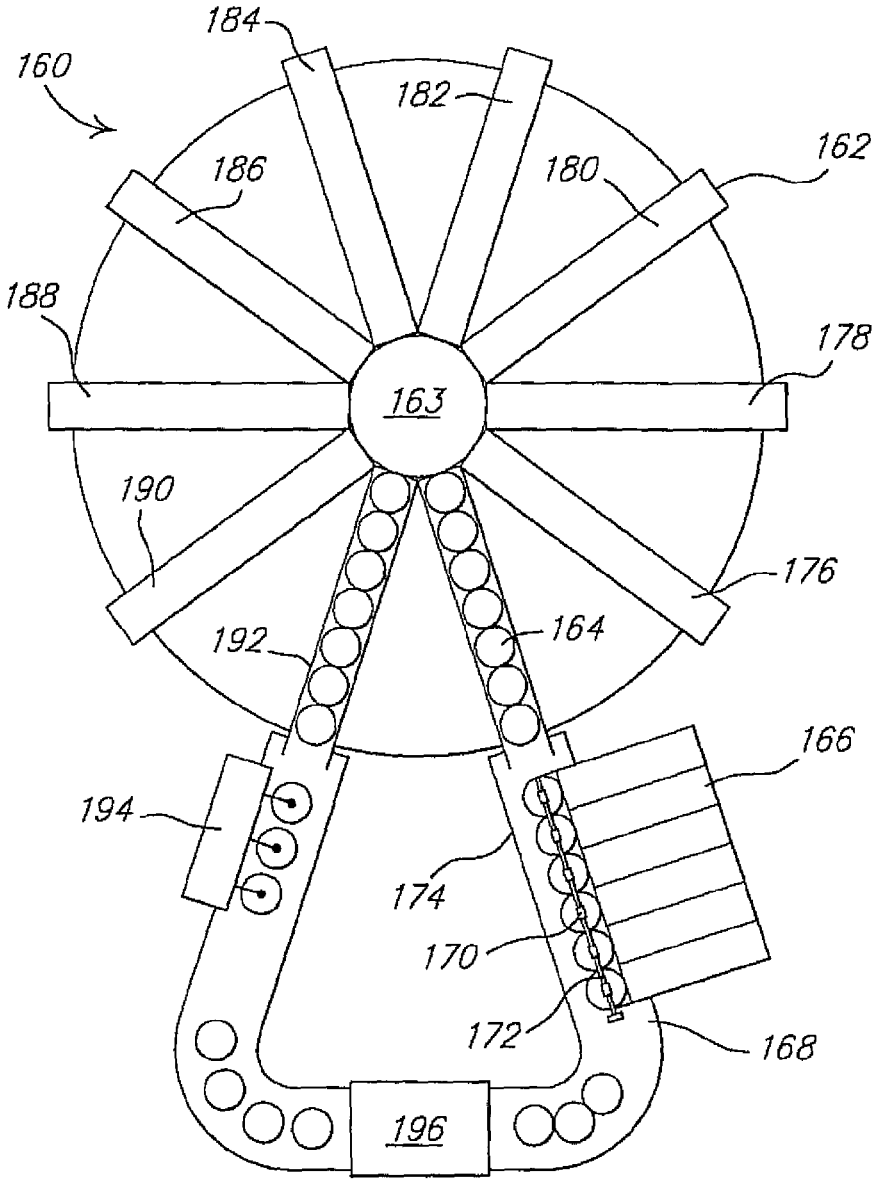
Figure 17:
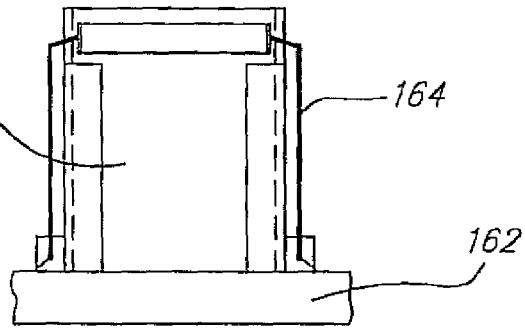
FIG. 17 is an elevational view of a receptacle for transporting the pouch, according to the present inventions.
Figure 18A:
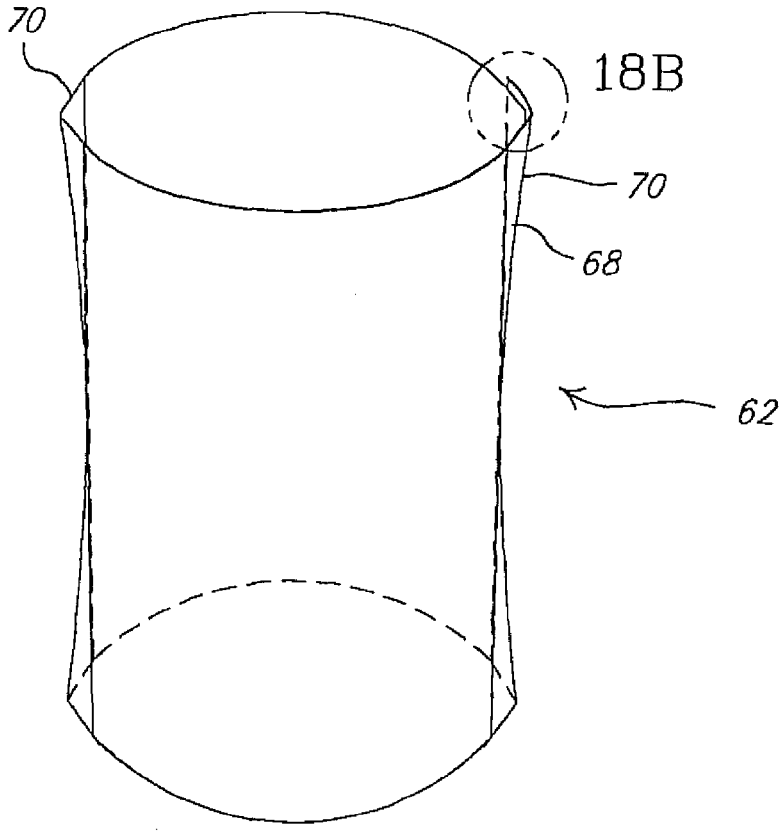
FIG. 18*a* is an elevational view of a pouch with an overlap flat seam in a side gusset, according to the present inventions.
Figure 18B:
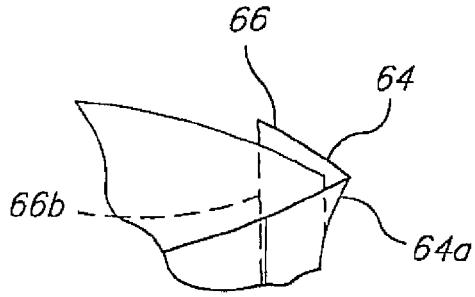
FIG. 18*b* is a detail view of the overlap flat seam in side gusset, according to the present inventions.
Figure 18C:
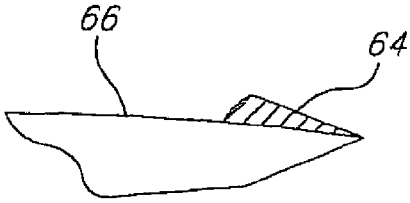
FIG. 18*c* is another detail view of the overlap flat seam in side gusset, according to the present inventions.

Referring to FIGS. 14-16, another example of a machine for carrying out the above-described method is illustrated. As shown in FIG. 16-17, the machine 160 is of a turret-type having radially extending arms 162. Each arm 162 carries a predetermined number of cuplike receptacles 164. As shown in FIG. 17, the receptacles 164 have a cylindrical wall extending upwardly from a bottom, as disclosed in co-pending Patent Application No. 60/345,230. There may be up to ten receptacles 164 on each arm 162. It should be appreciated that a particular manufacturing station may perform one or more operations. It should also be appreciated that the order of operations may vary.

The cups are delivered to a loading station by conveyor where empty pouches are loaded into the receptacles from magazines 166 onto a rotary turret 163. The pouches 10 are fully formed but the upper edges 16 of the walls 12, 14 are unsealed. Each magazine 166 or turret segment holds a supply of empty flat pouches 10. The same number of magazines or segments are needed as the number of receptacles 164, which will be loaded onto the arm 162 of the turret. The magazines are positioned side by side with the receptacles 164 below. A linear cam servo feed-in device 168 moves to push an empty pouch 10 from the magazine 166 into a receptacle 162 positioned beneath the magazine 166. The cam 170 engages the top pouch. The magazines are angled so that gravity pulls the pouches 10 downwardly to the cam 170 which pushes against the bottom pouch in the magazine and is rotated to slide the pouch from the magazine downwardly into the corresponding awaiting receptacle 164. The cams 170 are mounted to a single rod 172 which is rotated to move the cams in unison. The rotary turret picks a pouch 10 horizontally from the magazine 166 and loads onto a segment which transfers the empty pouch into the receptacle 164.

The group of receptacles 164 is then fed by the conveyor 174 sideways onto a radial arm 162 of the turret 163. The arms 162 are sequentially indexed through a number of stations. The turret 163 is rotated to move the receptacles 164 containing the pouches 10 to an opening station 176 where the flat pouches 10 are opened by a group of nozzles positioned above the pouches 10. The pouches 10 then are moved to a checking station where photocells or pressure is used to make sure the pouches have been opened, 178. The pouches 10 then move to a first filling station 180 where pouches could be evacuated and diving nozzles are lowered into the pouch 10 to fill the pouch 10 with the product. In the case of larger pouches, it may be necessary to move the pouches to a second fill station 182 to complete the filling of the pouch. The pouches 10 then are moved to a station 184 where any oxygen in the pouch residing above the product is removed, if necessary. This can be done by providing a hood or diving nozzle where oxygen is either evacuated or replaced with carbon dioxide or nitrogen into the pouch to displace the oxygen. A diving nozzle is used to inject the gas.

The pouches 10 are then moved to a pouch closing station 186 to entirely seal the pouch. For example, an ultrasonic sealing apparatus pushes the upper edges 16 of the walls 12, 14 together over the product and seals the walls 12, 14 together. As previously described, the heat sealing means may have a plasma coating. For a carbonated product, a first seal may be an ultrasonic seal and a second seal is applied above the first seal. The second seal is a heat weld, and some of the product may be trapped between the first seal and the second seal. For a noncarbonated product, the seal may be a heat weld, ultrasonic seal or the like. For a pouch with a curvilinear bottom edge, the closing seal is arcuate in shape, and is applied using any of the described techniques. The pouches are then moved to a finishing station 188. The pouches 10 may be cooled. The pouches may undergo a secondary operation, such as pasteurization at a pasteurization station 190.

The pouches are moved to a discharge station 192 where the receptacles 164 are moved from the arm 162 of the turret 163 outwardly onto the conveyor 174. The receptacles 164 are then moved by the conveyor 174 under robotic arms 194 having grippers which are then lowered to grab the pouch 10 and lift the pouch 10 from the receptacles 164. The receptacles 164 are then moved by the conveyor 174 through a rinsing station 196 and returned to the other side of the turret for use. The pouches 10 are placed by the grippers into cartons. At this point, the filled pouch is available for distribution. Alternatively, the filled pouch 10 may be placed onto another conveyor belt for additional processing, such as tunnel pasteurization for shelf stabilization. In certain instances, it may be desirable to apply steam to sterilize the pouch 10 and to wet the inner surface of the walls to facilitate handling.

As shown in FIGS. 14-15, the pouches 10 may be filled using an example of a continuous motion machine 210. The continuous motion machine has rows 212 of receptacles 164 mounted to a conveyor which are moved in an elliptical path past the same stations as set forth for the rotary machine above. Up to ten receptacles may extend across a row. Preformed pouches are fed from magazines located above the receptacles.

The various operations such as opening, checking, filling and sealing are performed by apparatus which moves over the receptacles at the same speed as the receptacles. Two sets of identical equipment such as opening equipment are utilized. The first set travels with the belt performing the operation while a second set is lifted upwardly by a chain along a frame and then moved rearwardly and down to the start position where it meets the next row of receptacles. The pouches are loaded into the receptacles and then moved to the start of the opening station 214 where blowers are moved down and travel with the pouches while the alternate set of blowers are moved upwardly and rearwardly. At the end of the travel through the opening station, the pouches are fully opened by diving wands 216. The pouches are then turned 180° to travel back down through the apparatus where they are moved sequentially through an evacuation station 218, fill station 220, closing station 222 and top seal station 226. At the opposite end of the machine, the robotic arms 228 move downwardly, grab the pouches and move them to a conveyor for loading into packaging. The pouches then are rotated 180° to the start position and the receptacles may be washed as they move around to the start position.

The present invention has been described in an illustrative manner. It is to be understood that the terminology which has been used is intended to be in the nature of words of description rather than of limitation.

Many modifications and variations of the present invention are possible in light of the above teachings. Therefore, the present invention may be practiced other than as specifically described.

The invention claimed is:

1. A flexible pouch for containing a product, said pouch comprising:

a pouch panel having a pair of side edges extending between an upper edge and an opposite bottom edge, a side seal sealing said pair of side edges to form a pouch body, an upper seal extending across said upper edge, said upper seal having one end adjacent said side seal and an opposite end adjacent a central portion of said pouch panel, said pouch body formed such that said bottom edge has a curvilinear shape having one end adjacent said side seal and an opposite end adjacent said central portion of said pouch panel, said curvilinear bottom edge having a curvilinear bottom seal extending along the curvilinear bottom edge to distribute a force from the product evenly across the curvilinear bottom seal, the curvilinear bottom seal having a lowermost bottom edge and an inner edge, said lowermost bottom edge and said inner edge being parallel curves that define the curvilinear shape of the curvilinear bottom seal, the curvilinear bottom seal extending from said central portion of said pouch panel to said side seal, said curvilinear bottom seal forms a continuous connection with said side seal;

a second partial bottom seal formed coincident with the curvilinear bottom seal, the second partial bottom seal is formed along the lowermost edge of the curvilinear bottom seal, and has a predetermined length and a predetermined width that is less than a corresponding width and length of the curvilinear bottom seal; and an opening device integrally formed in the pouch body for accessing the product contained within the pouch.

2. The pouch as set forth in claim 1 wherein the opening device is a fitment having a spout and a cap attachable to the spout.

3. The pouch as set forth in claim 1 wherein an obtuse angle is formed at a junction between the curvilinear bottom seal and a side edge seal.

4. The pouch as set forth in claim 1 wherein a pressure in the pouch from the product ergonomically shapes the pouch, such that a front wall and a back wall each have a longitudinally oriented convex shape and the side seal and an opposite smooth side edge of the pouch body each have a longitudinally oriented concave shape.

5. A method of forming a flexible pouch having a curvilinear bottom edge with a product, said method comprising the steps of:

forming a pouch body from a pouch panel having a pair of side edges extending between an upper edge and an opposite bottom edge, wherein the bottom edge of the pouch body is curvilinear;

aligning the pair of side edges to form the front wall and back wall of the pouch body;

forming a side seal to seal said pair of side edges to form said pouch body;

forming an upper seal extending across said upper edge, said upper seal having one edge adjacent said side seal and an opposite end adjacent a central portion of said pouch panel;

forming a curvilinear bottom seal along the curvilinear bottom edge of the pouch body, said curvilinear bottom seal having one end adjacent said side seal and an opposite end adjacent said central portion of said pouch panel, said curvilinear bottom seal extending along said bottom edge to distribute a force from the product evenly across the curvilinear bottom seal, said curvilinear bottom seal having a lowermost bottom edge and an inner edge, said lowermost bottom edge and said inner edge formed as parallel curves that define the curvilinear shape of the curvilinear bottom seal, the curvilinear bottom seal extending from said central portion of said pouch panel to said side seal, said curvilinear bottom seal forming a continuous connection with said side seal;

forming a second partial bottom seal coincident with the curvilinear bottom seal, wherein the second partial bottom seal is formed along the lowermost edge of the curvilinear bottom seal, and has a predetermined length and a predetermined width that is less than a corresponding width and length of the curvilinear bottom seal; and installing an opening device integrally formed in the pouch body for accessing the product contacted within the pouch; and installing an opening device integrally formed in the pouch body for accessing the product contained within the pouch.

6. The method as set forth in claim 5 wherein the step of forming the curvilinear bottom seal further includes forming a first bottom seal and forming a second bottom seal spaced a predetermined distance away from the first bottom seal, such that an air pocket is formed between the first bottom seal and the second bottom seal.

7. The method as set forth in claim 5 wherein the step of forming the curvilinear bottom seal further includes forming a second bottom seal coincident with the curvilinear bottom seal such that the second bottom seal has a predetermined length and a predetermined width that is less than a corresponding width and length of the curvilinear bottom seal.

8. The method as set forth in claim 5 further comprising the steps of:

opening the pouch;

filling the pouch with the product; and closing the pouch, wherein an inner edge of the curvilinear bottom seal evenly distributes a pressure from the product on the curvilinear bottom seal.

9. A flexible pouch for containing a carbonated product, said pouch comprising:

a pouch panel having a pair of side edges extending between an upper edge and an opposite bottom edge, a side seal sealing said pair of side edges to form a pouch body, an upper seal extending across said upper edge, said upper seal having one end adjacent said side seal and an opposite end adjacent a central portion of said pouch panel, said pouch body formed such that said bottom edge has a curvilinear shape having one end adjacent said side seal and an opposite end adjacent said central portion of said pouch panel, said curvilinear bottom edge having a curvilinear bottom seal extending along the curvilinear bottom edge to distribute a force from the product evenly across the curvilinear bottom seal, said curvilinear bottom seal having a lowermost bottom edge and an inner edge, said lowermost bottom edge and said inner edge being parallel curves that define the curvilinear shape of the curvilinear bottom seal, a second partial bottom seal coincident with the curvilinear bottom seal, said second partial bottom seal is formed along said lowermost edge of said curvilinear bottom seal, and said second partial bottom seal having a predetermined length and a predetermined width that is less than a corresponding width and length of said curvilinear bottom seal, an opening device integrally formed in the pouch body for accessing the carbonated product contained within the pouch.

* * * * *